US010446924B2

(12) United States Patent
Fujisawa

(10) Patent No.: US 10,446,924 B2
(45) Date of Patent: Oct. 15, 2019

(54) ELECTRONIC TIMEPIECE

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 534 days.

(21) Appl. No.: 15/219,558

(22) Filed: Jul. 26, 2016

(65) Prior Publication Data

US 2017/0040681 A1 Feb. 9, 2017

(30) Foreign Application Priority Data

Aug. 6, 2015 (JP) ..... 2015-156169
Feb. 10, 2016 (JP) ..... 2016-023812

(51) Int. Cl.

| | |
|---|---|
| ***H01Q 1/52*** | (2006.01) |
| ***H01Q 9/28*** | (2006.01) |
| ***H01Q 1/27*** | (2006.01) |
| ***H01Q 9/04*** | (2006.01) |

(52) U.S. Cl.

CPC ..... *H01Q 1/526* (2013.01); *H01Q 1/273* (2013.01); *H01Q 9/0407* (2013.01); *H01Q 9/285* (2013.01)

(58) Field of Classification Search

USPC ..... 343/720, 718; 368/47
See application file for complete search history.

(56) References Cited

U.S. PATENT DOCUMENTS

| | | | | |
|---|---|---|---|---|
| 8,467,272 | B2 * | 6/2013 | Fujisawa | G04G 5/002 368/47 |
| 8,804,466 | B2 * | 8/2014 | Matsuzaki | G04R 60/12 368/278 |
| 2009/0251997 | A1 | 10/2009 | Kimura | |
| 2011/0051561 | A1 | 3/2011 | Fujisawa | |
| 2012/0002512 | A1 | 1/2012 | Matsuzaki | |
| 2013/0235703 | A1 | 9/2013 | Fujisawa | |
| 2014/0022871 | A1 | 1/2014 | Fujisawa | |
| 2014/0086020 | A1 * | 3/2014 | Fujisawa | G04R 60/12 368/47 |
| 2014/0086026 | A1 | 3/2014 | Mitani et al. | |

(Continued)

FOREIGN PATENT DOCUMENTS

| | | |
|---|---|---|
| JP | 2009-250667 A | 10/2009 |
| JP | 2011-075541 A | 4/2011 |

(Continued)

*Primary Examiner* — Hai V Tran
(74) *Attorney, Agent, or Firm* — Harness, Dickey & Pierce, P.L.C.

(57) ABSTRACT

An electronic timepiece having a case of which at least part is metal, a magnetic shield, and a planar antenna can suppress a drop in the sensitivity of the planar antenna. The electronic timepiece 1 has a case 10 of which at least part is metal, and hands and a movement disposed inside the case 10. The movement includes a circuit board 23, a planar antenna 40 attached to the circuit board 23, a motor that drives the hands, and magnetic shields 91, 92 superimposed in plan view with at least part of the motor and not superimposed in plan view with the planar antenna. The shortest distance D1 between the antenna electrode 42 of the planar antenna 40 and the metal part of the case 10 is greater than the shortest distance D2 between the antenna electrode 42 and the magnetic shield 91.

6 Claims, 19 Drawing Sheets

(56) References Cited

U.S. PATENT DOCUMENTS

| | | | | |
|---|---|---|---|---|
| 2014/0232603 | A1* | 8/2014 | Fujisawa | G04R 60/12 343/702 |
| 2014/0233358 | A1 | 8/2014 | Fujisawa | |
| 2015/0092521 | A1 | 4/2015 | Fujisawa | |
| 2015/0323907 | A1 | 11/2015 | Fujisawa | |
| 2016/0161924 | A1 | 6/2016 | Fujisawa | |
| 2017/0038744 | A1 | 2/2017 | Fujisawa | |
| 2017/0293268 | A1 | 10/2017 | Fujisawa | |
| 2018/0246477 | A1 | 8/2018 | Fujisawa | |

FOREIGN PATENT DOCUMENTS

| | | | |
|---|---|---|---|
| JP | 2014-062846 | A | 4/2014 |
| JP | 2014-157160 | A | 8/2014 |

* cited by examiner

ELECTRONIC TIMEPIECE

BACKGROUND

1. Technical Field

The present invention relates to an electronic timepiece, and relates more particularly to an electronic timepiece with a planar antenna.

2. Related Art

JP-A-2014-157160 describes an electronic timepiece with a planar antenna for receiving radio frequency signals transmitted from positioning information satellites such as GPS (Global Positioning System) satellites.

The electronic timepiece in JP-A-2014-157160 has a photovoltaic device and a planar antenna disposed on the back cover side of the timepiece dial, and the planar antenna and photovoltaic device are disposed so they are not mutually superimposed in the direction perpendicular to the face of the dial. Reducing antenna sensitivity is suppressed by separating the planar antenna and photovoltaic device sufficiently in the direction parallel to the plane of the dial.

A magnetic shield may be incorporated in the movement of an electronic timepiece to prevent or reduce the effect of external magnetic fields on motors, for example. There is, therefore, a need for an electronic timepiece that can suppress loss of antenna sensitivity in an electronic timepiece having a case with metal parts, a magnetic shield, and a planar antenna.

SUMMARY

An objective of the present invention is to provide an electronic timepiece having a case with metal parts, a magnetic shield, and a planar antenna, and suppressing the loss of antenna sensitivity.

An electronic timepiece according to one aspect has a case of which at least part is metal; and hands and a movement disposed inside the case. The movement includes a circuit board, a planar antenna attached to the circuit board, a motor configured to drive the hands, and a magnetic shield superimposed in plan view with at least part of the motor, and not superimposed in plan view with the planar antenna. The shortest distance between the antenna electrode of the planar antenna and the metal part of the case is greater than the shortest distance between the antenna electrode and the magnetic shield.

An electronic timepiece according to another aspect has a case of which at least part is metal, a magnetic shield, and a planar antenna. Because the metal part of the case and the magnetic shield are metal materials, the signal-blocking effect thereof is great. More particularly, because the case is thick in the thickness of the timepiece, the effect on the reception sensitivity of the planar antenna is great. Because the distance from the antenna electrode of the planar antenna to the metal part of the case is greater than the distance from the antenna electrode to the magnetic shield, the antenna electrode and the metal case member can be separated relatively greatly, and the drop in reception sensitivity caused by the case can be reduced.

An electronic timepiece that can suppress loss of reception sensitivity in the planar antenna when a magnetic shield and planar antenna are disposed inside a case with metal parts can be provided.

In an electronic timepiece according to another aspect, the top of the metal part of the case at the end on the face side of the timepiece is above the antenna electrode on the face side of the timepiece.

Because the top of the metal part of the case can be located above the antenna electrode on the face side (crystal) side of the timepiece, the case body, bezel, and other members can be metal. An electronic timepiece with a metal case can therefore be provided, improving the appearance and imparting a luxury watch feel to the design of the timepiece. Furthermore, because the metal outside case has superior durability to a plastic case, for example, the surface is more scratch resistance and the internal movement can be protected.

An electronic timepiece according to another aspect preferably also has a solar panel not superimposed with the antenna electrode in plan view, and the shortest distance between the antenna electrode and the metal part of the case is greater than the shortest distance between the antenna electrode and the electrode of the solar panel.

This aspect can reduce the effect of the case on reception sensitivity because the distance from the antenna electrode of the planar antenna to the metal part of the case is greater than the distance from the antenna electrode to the electrode of the solar panel.

An electronic timepiece that can suppress loss of reception sensitivity in the planar antenna when a magnetic shield, solar panel, and planar antenna are disposed inside a case with metal parts can be provided.

Further preferably in an electronic timepiece according to another aspect, the shortest distance between the antenna electrode and the magnetic shield is greater than the shortest distance between the antenna electrode and the electrode of the solar panel.

This aspect can reduce the effect of the magnetic shield on reception sensitivity because the distance from the antenna electrode of the planar antenna to the magnetic shield is greater than the distance from the antenna electrode to the electrode of the solar panel. The magnetic shield is thicker than the electrode part of the solar panel, and has a greater effect on loss of planar antenna sensitivity than the electrode of the solar panel. Therefore, if the antenna electrode of the planar antenna is located farther from the magnetic shield than the electrode of the solar panel, the drop in planar antenna sensitivity can be suppressed compared with when the magnetic shield is closer than the electrode of the solar panel.

An electronic timepiece according to another aspect preferably also has a battery not superimposed with the planar antenna in plan view, the shortest distance between the antenna electrode and the metal part of the case being greater than the shortest distance between the antenna electrode and the battery.

Thus comprised, because the antenna electrode of the planar antenna can be separated farther from the metal case member than from the battery, the effect of metal parts of the case on reception sensitivity can be reduced. The battery is thinner than the case, and is often disposed in the thickness direction of the timepiece closer to the back cover than the antenna electrode. The effect of the battery on loss of sensitivity in the planar antenna is less than the effect of the case. Therefore, if the antenna electrode of the planar antenna is located farther from the case than from the battery, the drop in planar antenna sensitivity can be suppressed compared with when the case is closer to the antenna electrode than the battery.

Further preferably in an electronic timepiece according to another aspect, the magnetic shield includes a first magnetic shield on the face side of the motor, and a second magnetic shield disposed on the back cover side of the motor. The shortest distance between the antenna electrode and the first magnetic shield is greater than the shortest distance between the antenna electrode and the second magnetic shield.

Because the shortest distance between the antenna electrode and the first magnetic shield is greater than the shortest distance between the antenna electrode and the second magnetic shield, the first magnetic shield that easily affects reception performance and is closer to the crystal than the antenna electrode can be separated from the antenna electrode, and a drop in reception performance can be prevented. The surface area of the second magnetic shield can also be increased and magnetic resistance improved. Reception performance and magnetic resistance can therefore be more easily balanced.

Other objects and attainments together with a fuller understanding of the invention will become apparent and appreciated by referring to the following description and claims taken in conjunction with the accompanying drawings.

DESCRIPTION OF EMBODIMENTS

Embodiment 1

A first embodiment of an electronic timepiece 1 is described below with reference to the accompanying figures. Note that the crystal 31 side of the electronic timepiece 1 in the following embodiments is also referred to as the face, front, or top side, and the back cover 12 side is also referred to as the back or bottom side of the electronic timepiece 1.

As described further below, an electronic timepiece 1 according to this embodiment receives satellite signals and acquires satellite time information from plural positioning information satellites S, such as GPS satellites or quasi-zenith satellites, orbiting the Earth on known orbits, and can correct internal time information based on the acquired satellite time information.

Figure 1:
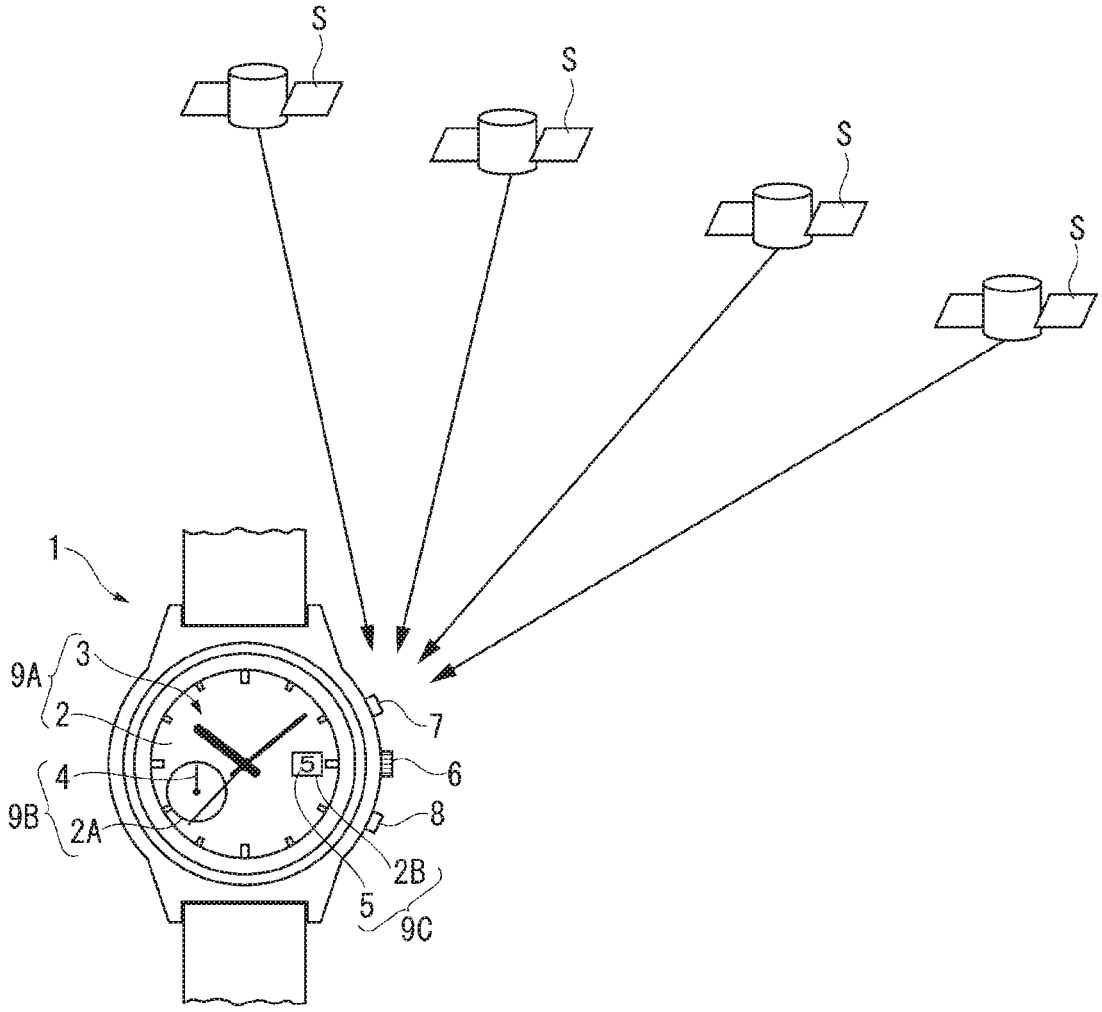
FIG. 1 illustrates an electronic timepiece according to a first embodiment.
Figure 2:
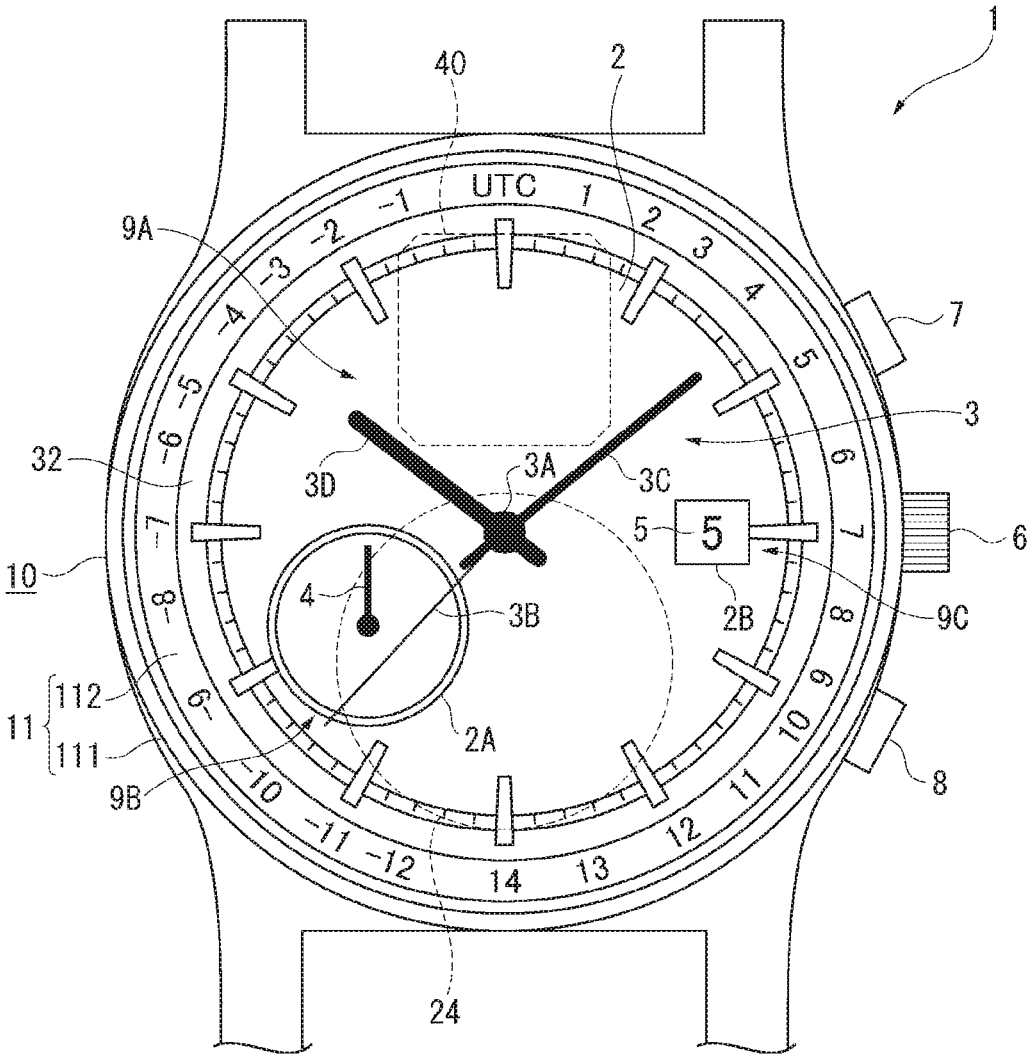
FIG. 2 is a plan view of the electronic timepiece.

As shown in FIG. 1 and FIG. 2, the electronic timepiece 1 is a wristwatch with a time display unit 9A for displaying time using a dial 2 and hands 3, an information display unit 9B including a subdial 2A of the dial 2 and a hand 4, and a calendar display unit 9C including a window 2B in the dial 2 and a date wheel 5. The electronic timepiece 1 also has a crown 6 and buttons 7 and 8 as external operating members.

The hands 3 include a second hand 3B, minute hand 3C, and hour hand 3D. The time display unit 9A therefore indicates the current time with the dial 2 and hands 3. The information display unit 9B including the subdial 2A and hand (small hand) 4 displays information such as the timekeeping mode, day of the week, remaining battery capacity, or reception condition. The calendar display unit 9C displays the current date.

The hands 3, 4 and date wheel 5 are driven by stepper motors 221 to 224 and a wheel train 226 described further below.

Figure 3:
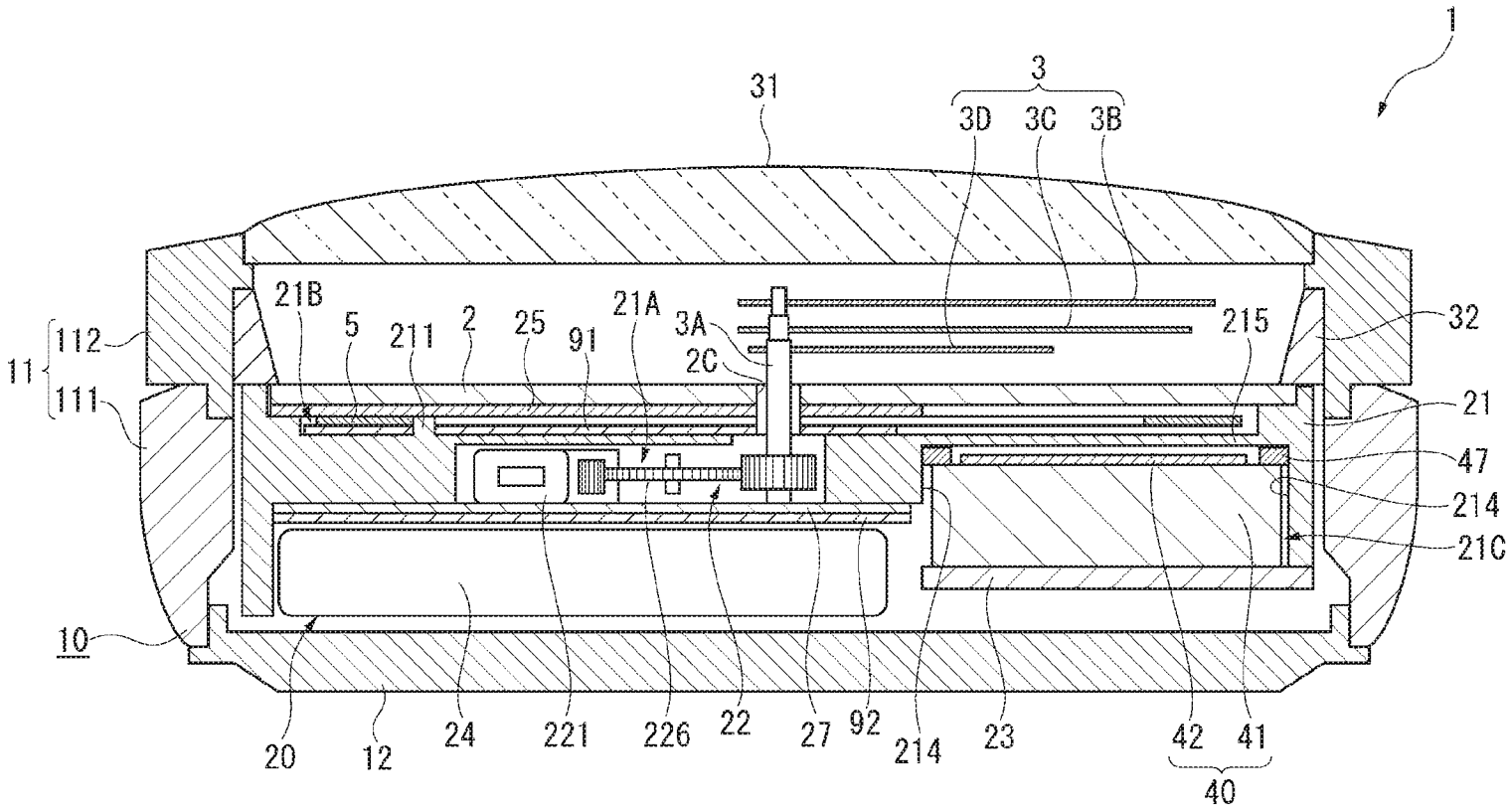
FIG. 3 is a section view of the electronic timepiece.
Figure 4:
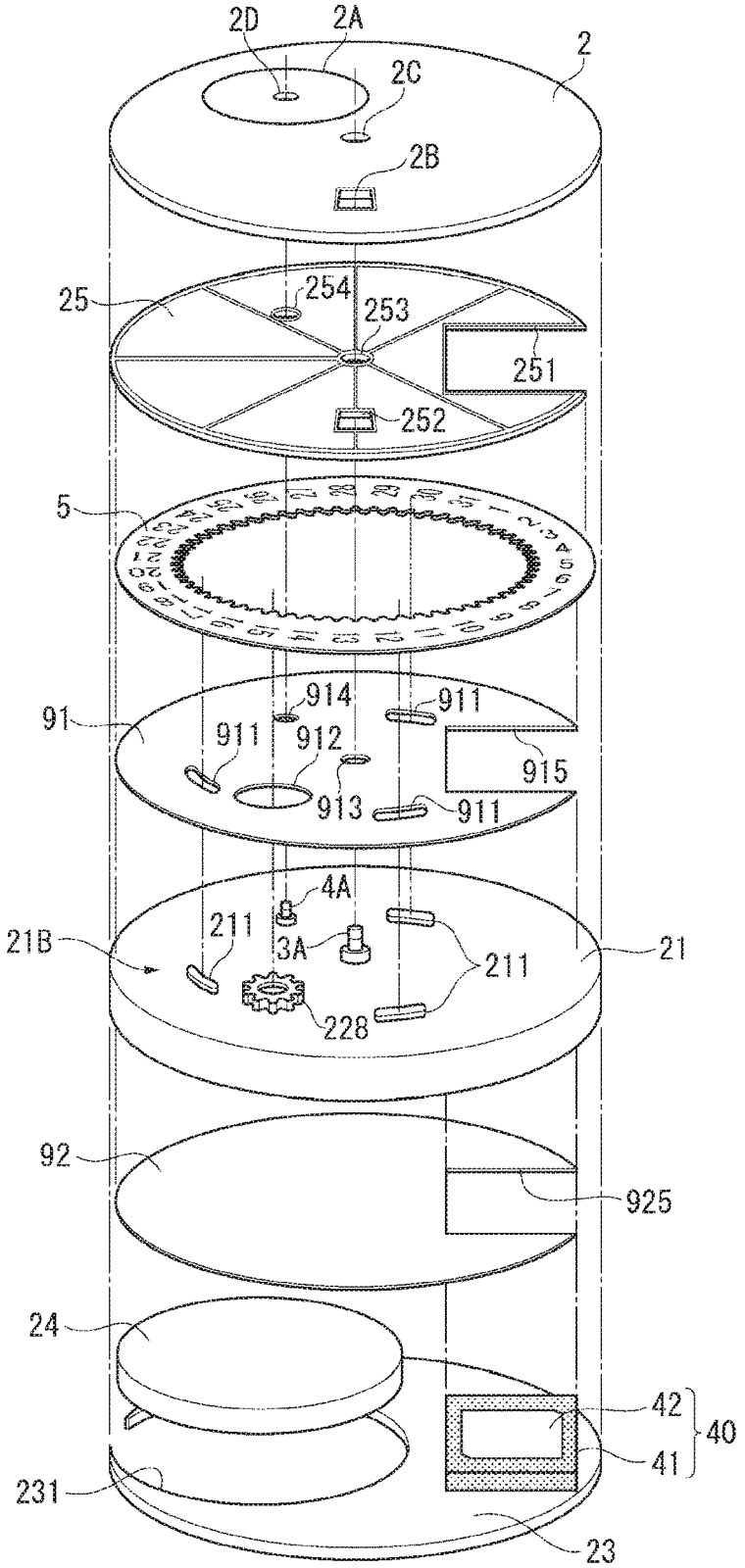
FIG. 4 is a partially exploded oblique view of the electronic timepiece.

The dial 2 is a disc-shaped member made of polycarbonate or other non-conductive material. The subdial 2A is located at 8:00 on the dial 2, and the window 2B is located at 3:00 on the dial 2. In addition to the subdial 2A and window 2B, a through-hole 2C through which the center pivot 3A of the hands 3 passes, and a through-hole 2D through which the pivot 4A of the small hand 4 passes, are formed in the dial 2 as shown in FIG. 3 and FIG. 4. Through-hole 2C is formed in the plane center of the dial 2. Through-hole 2D is formed on or near a line through the through-hole 2C and 8:00 on the dial 2.

External Structure of the Electronic Timepiece

As shown in FIG. 2 and FIG. 3, the electronic timepiece 1 has an external case 10 that houses a movement 20 described further below. Note that FIG. 3 is a section view on a line through 6:00 and 12:00 on the dial 2.

The case 10 includes the main case 11, the back cover 12, and the crystal 31. The main case 11 includes a tubular case member 111, and a bezel 112 disposed on the front side of the case member 111.

The bezel 112 is ring-shaped. The bezel 112 and case member 111 are connected by an interlocking tongue-and-groove structure formed on their mutual opposing surfaces, or by double-sided adhesive tape or adhesive, for example. The bezel 112 may also be attached so that it can rotate on the outside case member 111.

The crystal 31 is attached to the inside of the bezel 112 and is held by the bezel 112.

A round back cover 12 is disposed to the back cover side of the main case 11 covering the opening in the back cover side of the main case 11. The back cover 12 and the outside case member 111 of the main case 11 screw together.

Note that the outside case member 111 and the back cover 12 are separate members in this embodiment, but the invention is not so limited and the outside case member 111 and back cover 12 may be formed in unison as a single piece.

The outside case member 111, bezel 112, and back cover 12 are made of stainless steel, titanium alloy, aluminum, brass, or other metal material.

Internal Configuration of the Electronic Timepiece

The internal structure housed in the case 10 of the electronic timepiece 1 is described next.

As shown in FIG. 3, a movement 20, planar antenna 40 (patch antenna), date wheel 5, and dial ring 32 are housed in addition to the dial 2 inside the case 10.

As also shown in FIG. 4, the movement 20 includes the base plate 21, a wheel train bridge 27, a drive module 22 supported by the base plate 21 and wheel train bridge 27, a circuit board 23, a storage battery 24, a solar panel 25, and magnetic shields 91, 92.

The base plate 21 is made from plastic or other non-conductive material. The base plate 21 includes a drive module housing 21A that holds the drive module 22, a date wheel housing 21B where the date wheel 5 is disposed, and an antenna housing 21C that holds the planar antenna 40. The date wheel housing 21B is an area on the outside side of plural guide parts 211 that protrude from the face side of the base plate 21.

The drive module housing 21A and antenna housing 21C are disposed on the back side of the base plate 21. As shown in FIG. 3, the antenna housing 21C has four walls 214 (only two shown in FIG. 3) facing the four sides of the planar antenna 40, which is rectangular in plan view, and a cover part 215 opposite the face side of the planar antenna 40. The cover part 215 in this embodiment covers the entire surface of the planar antenna 40, but a through-hole superimposed in plan view with at least part of the antenna electrode 42 of the planar antenna 40 may be formed in the cover part 215. Note that the four walls 214 and the cover part 215 are formed in unison with the base plate 21.

Because the antenna housing 21C is at 12:00 on the dial 2 in plan view, the planar antenna 40 is also located at 12:00 as shown in FIG. 2. More specifically, the planar antenna 40 is located between the center pivot 3A of the hands 3 and the main case 11, and between approximately 11:00 and 1:00 on the dial 2.

Figure 5:
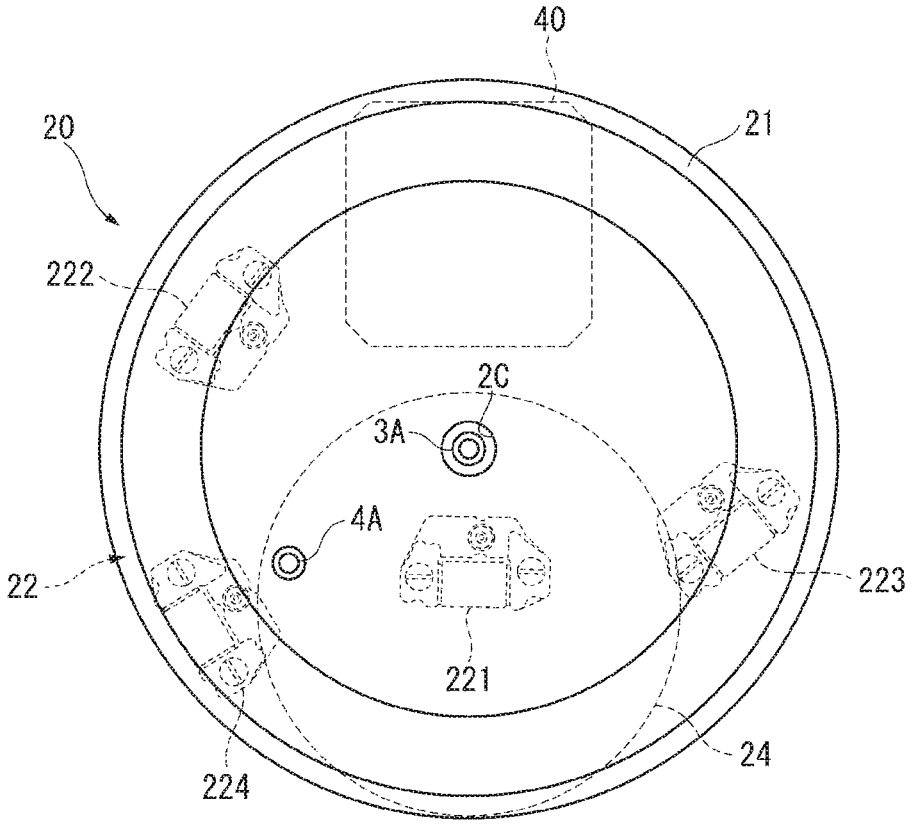
FIG. 5 is a plan view showing main parts of the movement of the electronic timepiece.

The drive module 22 is held in the drive module housing 21A of the base plate 21, and drives the hands 3, 4 and date wheel 5 of the time display unit 9A, information display unit 9B, and date display unit 9C. More specifically, as shown in FIG. 5, the drive module 22 includes a stepper motor 221 and first wheel train 226 for driving the hands 3 (FIG. 3); a second stepper motor 222 and second wheel train (not shown in the figure) for driving the minute hand 3C; a third stepper motor 223 and third wheel train (not shown in the figure) for driving the hour hand 3D; and a fourth stepper motor 224 and fourth wheel train (not shown in the figure) that are used to drive both hand 4 and the date wheel 5. The fourth wheel train has a date indicator driving wheel 228 (FIG. 4) for turning the date wheel 5.

The stepper motors 221 to 224 are disposed to positions not superimposed in plan view with the planar antenna 40.

Magnetic Shields

High performance magnets are commonly used in the cases of smartphones and other mobile terminals, for example, and magnetic resistance is therefore also needed in wristwatches. To reroute magnetic fields and prevent misoperation of the stepper motors 221 to 224, magnetic shields 91, 92 made of a high permeability material such as pure iron are disposed at positions superimposed in plan view with the stepper motors 221 to 224. Each of the stepper motors 221 to 224 has a coil wound around a core, a stator, and a rotor. Because the coil portion of these is most resistant to the effects of external magnetic fields, the magnetic shields 91, 92 do not necessarily need to be overlapping in plan view. The magnetic shields 91, 92 therefore preferably overlap at least part of the stepper motors 221 to 224 in plan view, and more particularly overlap the stator and rotor in plan view.

As shown in FIG. 3 and FIG. 4, the magnetic shield 91 is on the face side (crystal 31 side) of the base plate 21. This magnetic shield 91 is disposed substantially covering the surface (the dial 2 side surface) of the stepper motors 221 to 224.

As shown in FIG. 4, apertures 911 in which the guide parts 211 are disposed, an aperture 912 in which the date indicator driving wheel 228 is disposed, and apertures 913, 914 in which the center pivots 3A, 4A are disposed, are formed in the magnetic shield 91.

The area of the magnetic shield 91 superimposed in plan view with the planar antenna 40 is cut out, forming a notch 915. As a result, the magnetic shield 91 does not cover the crystal side of the planar antenna 40, and the planar antenna 40 can receive signals through the notch 915 in the magnetic shield 91.

As shown in FIG. 3 and FIG. 4, the magnetic shield 92 is on the back side (back cover 12 side) of the base plate 21, and is closer to the crystal than the storage battery 24. More specifically, a wheel train bridge 27 that supports the bearings of the wheel trains is on the back cover side of the base plate 21, and the magnetic shield 92 is disposed to the back cover side of the wheel train bridge 27. As a result, the magnetic shield 92 is disposed substantially covering the back side (the back cover 12 side) of the stepper motors 221 to 224.

The magnetic shield 92 is similarly cut out in the area superimposed in plan view with the planar antenna 40, forming a notch 925.

Circuit Boards

The electronic timepiece 1 in this embodiment has two circuit boards, a circuit board 23 for GPS reception, and a circuit board (not shown in the figure) for timepiece drive control. A timepiece control chip (CPU) 61 (FIG. 11), and a timepiece drive control chip (drive circuit) 62 (FIG. 11), that receive signals from the circuit board 23 for reception are disposed to the circuit board for timepiece drive control.

Figure 6:
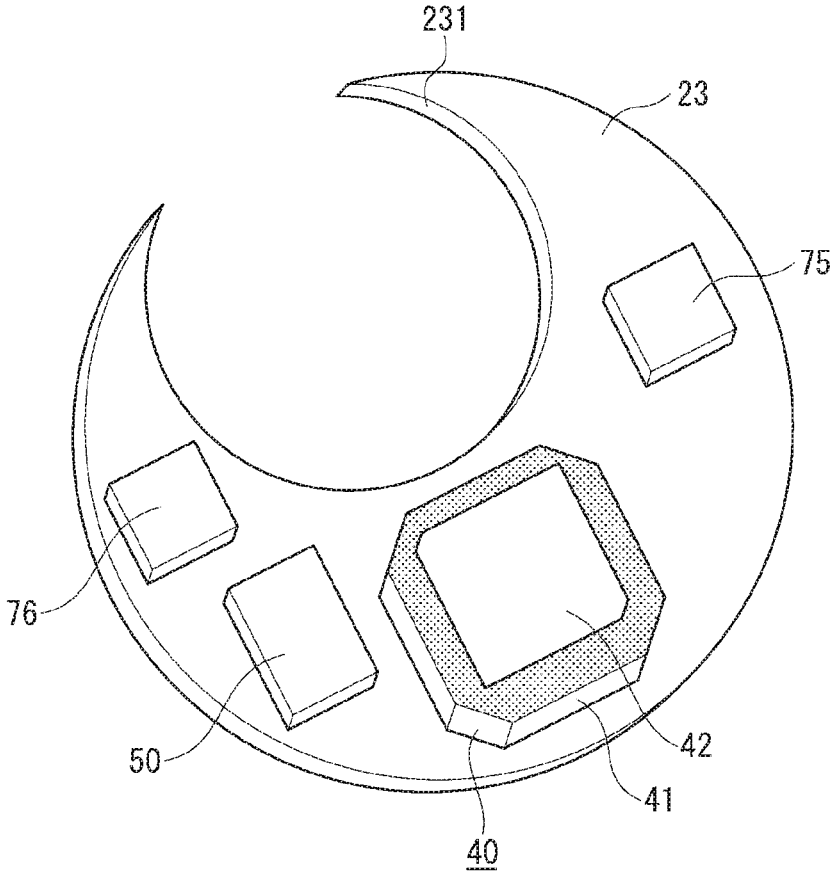
FIG. 6 is an oblique view showing a circuit board and the planar antenna of the electronic timepiece.

As shown in FIG. 4 and FIG. 6, the circuit board 23 for GPS reception is substantially round, and has a substantially round notch 231 in which a storage battery 24 is placed. The electronic timepiece 1 can be made smaller by placing the storage battery 24 in this notch 231. The planar antenna (patch antenna) 40 is mounted on the dial side of the circuit board 23. As shown in FIG. 6, a reception module 50 (receiver device, receiver chip, GPS module) that processes satellite signals received from the GPS satellites S, a power supply chip 75, and a memory chip 76 are also disposed on the front side of the circuit board 23. The memory chip 76 is flash memory, and stores a firmware program for GPS reception, and time zone data for calculating the time zone from location information calculated in a positioning reception process.

In this embodiment, the movement 20 is housed inside a metal main case 11, and radio waves are easily blocked. Therefore, to improve reception performance, the planar antenna 40 is preferably disposed to a position as close as possible to the dial 2. As a result, the circuit board 23 to which the planar antenna 40 is affixed is preferably also close to the dial 2.

A lithium ion battery that is round in plan view is used for the storage battery 24 as shown in FIG. 3 to FIG. 5. The storage battery 24 supplies power to the drive module 22 and reception module 50. The storage battery 24 is disposed in the notch 231 in the circuit board 23, and is disposed to a position not superimposed with the planar antenna 40, reception module 50, and power supply chip 75 in plan view, and more specifically is disposed at the 6:00 side of the dial 2.

The storage battery 24 is superimposed in plan view with at least part of the stepper motors 221, 223, 224 and the wheel train. The thickness (the dimension through the thickness of the timepiece) of the storage battery 24 is less than the diameter of the storage battery 24 (the dimension parallel to the surface of the back cover 12), and the storage battery 24 is flat and disposed in the notch 231 of the circuit board 23. As a result, a thin electronic timepiece 1 can be achieved even if the storage battery 24 is superimposed in plan view with part of the stepper motors and wheel train.

Solar Panel

The electrodes of the solar panel 25 include front electrodes and back electrodes. The front electrode is a transparent electrode made of indium tin oxide (ITO) or other transparent electrode material that passes light. An amorphous silicon semiconductor thin film is formed as the photovoltaic layer on a plastic film base layer.

Because GPS satellite signals are high frequency signals of approximately 1.5 GHz, GPS signals are attenuated by even the thin transparent electrode of the solar panel, unlike the long wave standard time signals that are received by radio-controlled timepieces, and antenna performance drops. As a result, as shown in FIG. 4, a notch 251 is formed in the disc-shaped solar panel 25 at the position overlapping the planar antenna 40 in plan view. The solar panel 25 therefore covers the face side of the base plate 21 but does not cover the face side of the planar antenna 40. The planar antenna 40 can therefore receive signals through the notch 251 in the solar panel 25.

Note that an opening 252 superimposed in plan view with the window 2B in the dial 2, and holes 253, 254 through which the center pivots 3A, 4A of the hands 3, 4 pass, are also formed in the solar panel 25.

The solar panel 25 is divided into plural cells, and the cells are connected in series. As shown in FIG. 4, the solar panel 25 in this embodiment has seven solar cells, and the solar cells are connected in series. One solar cell produces approximately 0.6 V or more. By connecting the seven solar cells in series, the solar panel 25 therefore produces approximately 0.6 V×7=approximately 4.2 V or more. A lithium ion storage battery with a high EMF can therefore be charged, and devices with high current consumption, such as a GPS receiver (GPS module) can be driven.

Date Indicator

The date wheel 5, which is a ring-shaped calendar wheel having date numbers displayed on the surface, is held in the date wheel housing 21B of the base plate 21. The date wheel 5 is made from plastic or other non-conductive material. In plan view, the date wheel 5 overlaps at least part of the planar antenna 40. Note that the calendar wheel is not limited to a date wheel 5, and may be a day wheel showing the days of the week, or a month wheel showing the months.

Dial

The dial 2 is disposed on the face side of the base plate 21 covering the face side of the solar panel 25 and the date wheel 5. The dial 2 is made from a material such as plastic that is non-conductive and transparent to at least some light.

Abbreviations or other markings may be disposed to the surface of the dial 2 overlapping the planar antenna 40 in plan view. To improve the reception performance of the planar antenna 40, these parts are preferably made from plastic or other non-conductive material instead of metal. The subdial 2A and markings thereof that are not located over the planar antenna 40 may be metal.

Because the dial 2 is transparent to light, the solar panel 25 located on the back side of the dial 2 can be seen through the dial 2 from the front of the timepiece. The color of the dial 2 therefore appears different in the areas where the solar panel 25 is present and where the solar panel 25 is not present. Design accents may be added to the dial 2 so that this color difference is not conspicuous.

Furthermore, because a notch 251 is formed in the solar panel 25, the color of the dial 2 in the area over the notch 251 may also appear different from other areas. To prevent this, a plastic sheet of the same color (such as dark blue or purple) as the solar panel 25 may be disposed below the solar panel 25, or the plastic film base layer may be left covering all of the solar panel 25, removing only the electrode layer that blocks radio waves in the part covering the planar antenna 40 in plan view.

Dial Ring

A dial ring 32 that is a ring shaped member made of a plastic non-conductive material (such as ABS plastic) is disposed to the face side of the dial 2. The dial ring 32 is disposed around the circumference of the dial 2, is conically shaped with the inside circumference surface sloping down to the dial 2, and has hour markers or world time zone markers printed on the sloping inside surface. By molding the dial ring 32 from plastic, reception performance can be maintained, complicated shapes can be formed, and design creativity can be improved.

The dial ring 32 is held pressed against the dial 2 by the bezel 112. In plan view from the crystal 31 side, the time display unit 9A in this embodiment therefore comprises the hands 3 and the area where markers indicated by the hands 3 can be seen, and more specifically includes the exposed area of the dial 2 delineated by the dial ring 32, the hands 3, and the exposed surface of the dial ring 32 delineated by the bezel 112. In other words, the time display unit 9A comprises the round portion delineated by the inside circumference surface of the bezel 112 when looking at the electronic timepiece 1 from the crystal 31 side.

Planar Antenna

The planar antenna 40, which is a patch antenna (microstrip antenna) is disposed in the antenna housing 21C of the base plate 21. The planar antenna 40 receives satellite signals from GPS satellites S.

In plan view, the planar antenna 40 is not superimposed with the main case 11 (outside case member 111 and bezel 112), the solar panel 25, or the magnetic shields 91, 92, and is superimposed with the date wheel 5, dial 2, and crystal 31, which are made of non-conductive materials. More specifically, all parts of the electronic timepiece 1 that are over the planar antenna 40 on the face side of the planar antenna 40 are made from non-conductive materials.

As a result, satellite signals coming from the face side of the timepiece first pass through the crystal 31, pass through the dial 2, date wheel 5, and base plate 21 without being blocked by the main case 11, magnetic shields 91, 92, or the solar panel 25, and are then incident to the planar antenna 40. Note that because the area of the hands 3, 4 over the planar antenna 40 is small, they do not interfere with receiving satellite signals even if they are made of metal, but are preferably made from a non-conductive material because they will interfere with satellite signal reception even less.

The GPS satellites S transmit satellite signals as right-hand circularly polarized waves. As a result, the planar antenna 40 in this embodiment is a patch antenna (also called a microstrip antenna) with excellent circular polarization characteristics.

Figure 7:
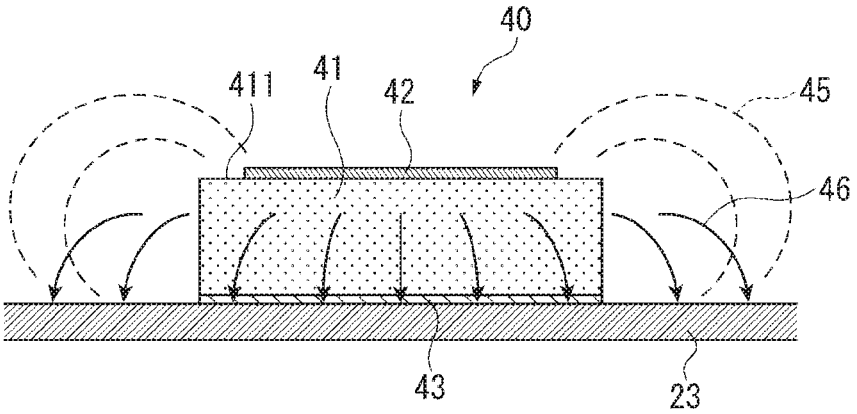
FIG. 7 is a section view of the structure of the planar antenna of the electronic timepiece.

As shown in FIG. 7, the planar antenna 40 in this embodiment is a patch antenna having a conductive antenna electrode 42 stacked on a ceramic dielectric substrate 41.

This planar antenna 40 is manufactured as described below. First, barium titanate with a dielectric constant of 60-100 is formed to the desired shape in a press and sintered to complete the ceramic dielectric substrate 41 of the antenna. Aground electrode 43 forming the ground plane (GND) of the antenna is made by screen printing a primarily silver (Ag) paste, for example, on the back side (the side facing the circuit board 23) of the dielectric substrate 41.

An antenna electrode 42 that determines the antenna frequency and the polarity of the received signals is formed on the face side of the dielectric substrate 41 (the side facing the base plate 21 and dial 2) by the same method as the ground electrode 43. The antenna electrode 42 is slightly smaller than the surface of the dielectric substrate 41, and an exposed surface 411 where the antenna electrode 42 is not present is disposed around the antenna electrode 42 on the surface of the dielectric substrate 41.

The surface of the dielectric substrate 41 in plan view is basically square with each side approximately 11 mm long in this example. The surface of the antenna electrode 42 in plan view is basically square with each side approximately 8 to 9 mm in this example. As shown in FIG. 6, the four corners of the dielectric substrate 41 are mitered to prevent cracking, but substrates that are not mitered may be used.

FIG. 7 illustrates the operating principle of a planar antenna 40 (patch antenna). In FIG. 7 the dotted lines 45 represent radio waves transmitted or received by the planar antenna 40, and the arrows 46 represent the electric lines of force.

A square patch antenna resonates when one side is a half wavelength, and a round patch antenna resonates when the diameter is approximately 0.58 wavelength, but the size of the antenna size can be reduced by the wavelength shortening effect of a ceramic or other dielectric. Because a patch antenna works by the strong electric field around the edge of the patch (antenna electrode 42) radiating from the edge into space (when used as a transmission antenna), the electric lines of force become stronger with proximity to the antenna and are easily affected by the effects of nearby metals and dielectrics. The effect of metal parts located above (on the crystal 31 side) of the circuit board 23, which is the ground (GND), are particularly great. To receive GPS satellite signals, therefore, the distance between the metal case member 111 and the antenna electrode 42 must be at least 2 mm, and is ideally approximately 3 mm or more.

In this example, the walls 214 are located between the planar antenna 40 and case member 111, and as described below the planar antenna 40 is disposed to a position separated at least a specific distance from the inside surface of the case member 111. As a result, a drop in reception performance resulting from the proximity of the planar antenna 40 to the metal case member 111 can be suppressed, and the reception performance required by the electronic timepiece 1 can be assured. Note also that the dielectric substrate 41 and antenna electrode 42 of the planar antenna 40 in this embodiment are basically rectangular in plan view.

Figure 8:
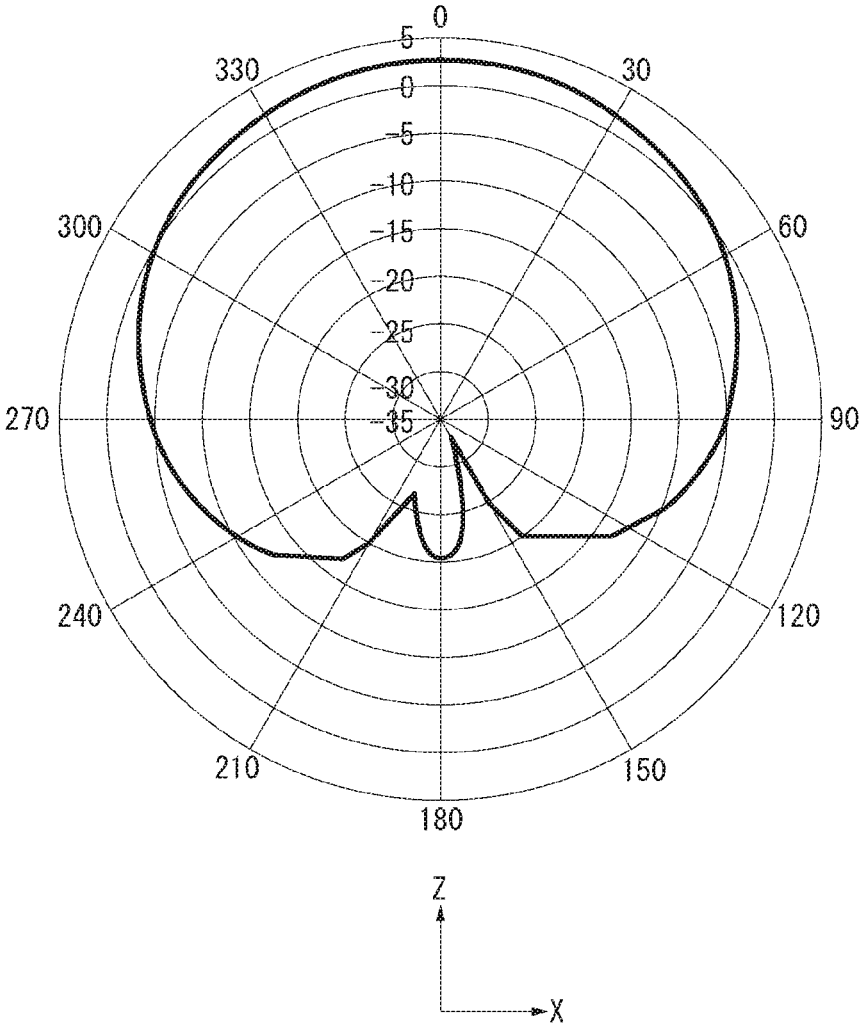
FIG. 8 illustrates the radiation pattern of the planar antenna of the electronic timepiece.

FIG. 8 illustrates the radiation pattern of the planar antenna 40, the plane of the planar antenna 40 (patch antenna) on the X-axis and the zenith on the Z-axis.

As shown in FIG. 8, because the planar antenna 40 is unidirectional with antenna gain greatest on the Z-axis toward the zenith, radio waves perpendicularly incident to the dial 2 are the easiest to receive. Furthermore, while directivity on the X-axis parallel to the plane of the planar antenna 40 is low compared with the Z-axis, because it is not totally absent, proximity of the metal main case 11 (case member 111) to the side of the planar antenna 40 also affects reception performance.

Furthermore, because directivity on the −Z-axis below the planar antenna 40 is weak, metal parts and the back cover 12 located below the planar antenna 40 have little effect on reception performance compared with a linear antenna such as an inverted-F antenna having uniform directivity in all directions. Compatibility with a metal case is therefore good, and incorporation in the case 10 according to this embodiment is simple.

Note also that because the electronic timepiece 1 is worn on the user's wrist and may receive satellite signals from many different directions, the planar antenna 40 preferably has directivity in directions other than the zenith as shown in FIG. 8. Directivity of the planar antenna 40 can then be improved by making the bezel 112 and dial ring 32 from non-conductive materials.

The planar antenna 40 is mounted on the face side of the circuit board 23, and is electrically connected to the antenna and GPS module, the reception module 50, on the circuit board 23. The circuit board 23 can also function as a ground plane by connecting the ground electrode 43 of the planar antenna 40 through the ground pattern of the circuit board 23 to the ground node of the reception module 50. The case member 111 and back cover 12 can also be used as the ground plane by connecting the ground node of the reception module 50 through the ground pattern of the circuit board 23 to the metal case member 111 or back cover 12.

As shown in FIG. 3, the planar antenna 40 is held in the antenna housing 21C by affixing the circuit board 23 to the base plate 21. Because the dielectric substrate 41 of the planar antenna 40 is ceramic, hard, and easily chipped, a shock absorber 47 such as a sponge cushion is disposed between the dielectric substrate 41 and the base plate 21. Damage to the dielectric substrate 41 by collision with the base plate 21 can therefore be prevented.

Distance between the Antenna Electrode and Metal Parts

The relationship between the location of metal parts disposed around the planar antenna 40 and the antenna electrode 42 in the electronic timepiece 1 is described next with reference to FIG. 9 and FIG. 10. In this embodiment, the metal parts located around the planar antenna 40 are the main case 11 (outside case member 111) of the case 10, the magnetic shields 91, 92, the electrode of the solar panel 25, and the storage battery 24.

In the figures, the shortest distance between the antenna electrode 42 and main case 11 is D1; the shortest distance between the antenna electrode 42 and the magnetic shield 91 disposed on the back of the dial 2 is D2; the shortest distance between the antenna electrode 42 and the magnetic shield 92 on the back side of the wheel train bridge 27 is D3; the shortest distance between the antenna electrode 42 and the electrode of the solar panel 25 is D4; and the shortest distance between the antenna electrode 42 and the storage battery 24 is D5.

As described above, because the planar antenna 40 has strong directivity toward the zenith (the direction toward the crystal 31), the reception sensitivity of the planar antenna 40 is easily affected by the case 10, which is the thickest of the metal parts and is located closer to the face of the timepiece than the planar antenna 40. As a result, the shortest distance D1 between the antenna electrode 42 of the planar antenna 40 and the case 10 must be increased to sufficiently separate the antenna electrode 42 from the case 10.

Furthermore, while the magnetic shield 91 is between the crystal 31 and the planar antenna 40, the magnetic shield 91 is thin at approximately 0.2-0.5 mm and has less effect on reception sensitivity than the thick case 10. As a result, the shortest distance D2 between the antenna electrode 42 and magnetic shield 91 is shorter than shortest distance D1.

Figure 10:
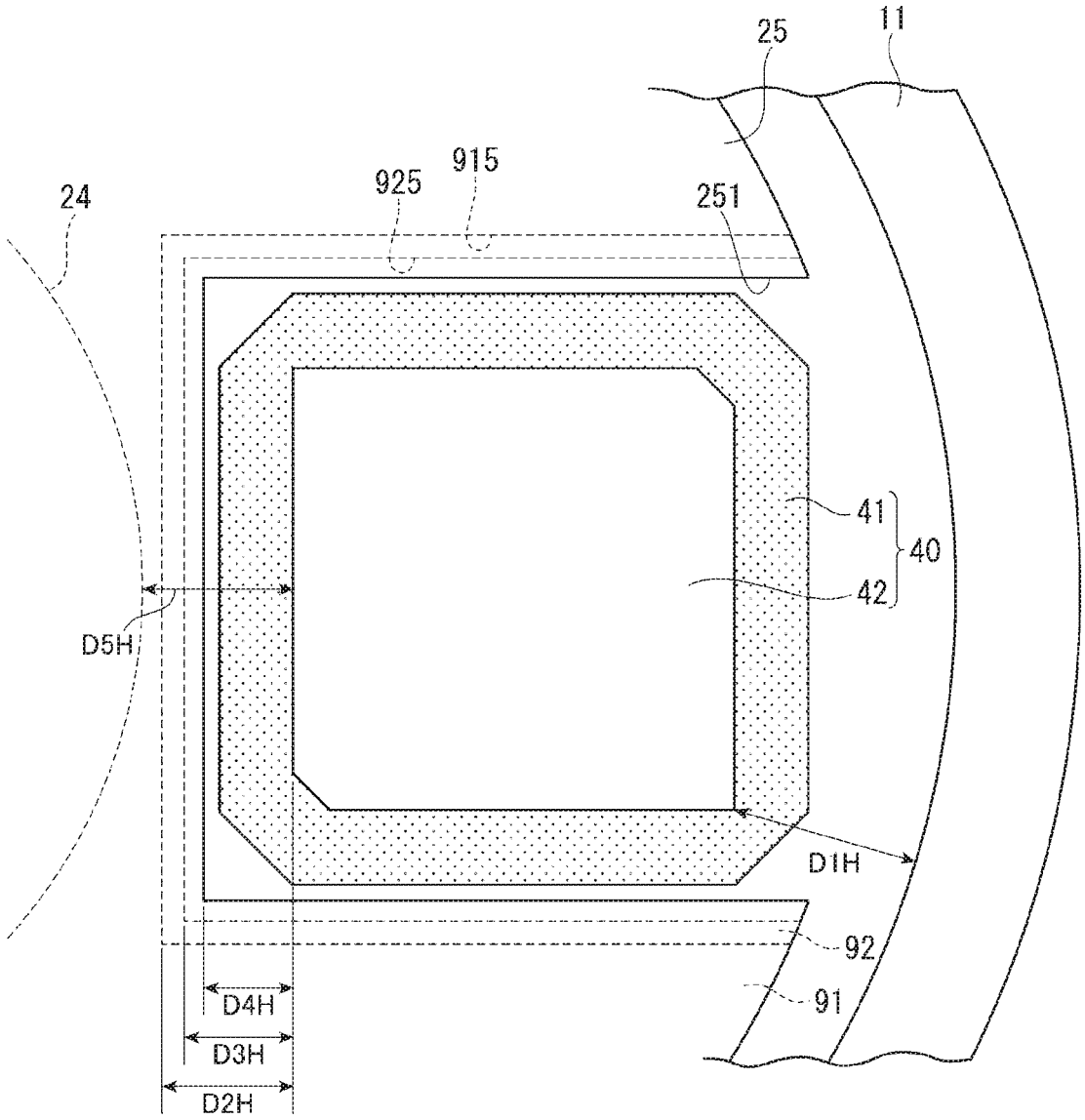
FIG. 10 describes the relative positions of the antenna electrode and metal parts of the electronic timepiece.

Note that because the inside surface of the main case 11 is round, the shortest distance D1 between the antenna electrode 42 and main case 11 is the shortest distance D1H between the corner of the antenna electrode 42 and the inside surface of the main case 11 in plan view as shown in FIG. 10.

Figure 9:
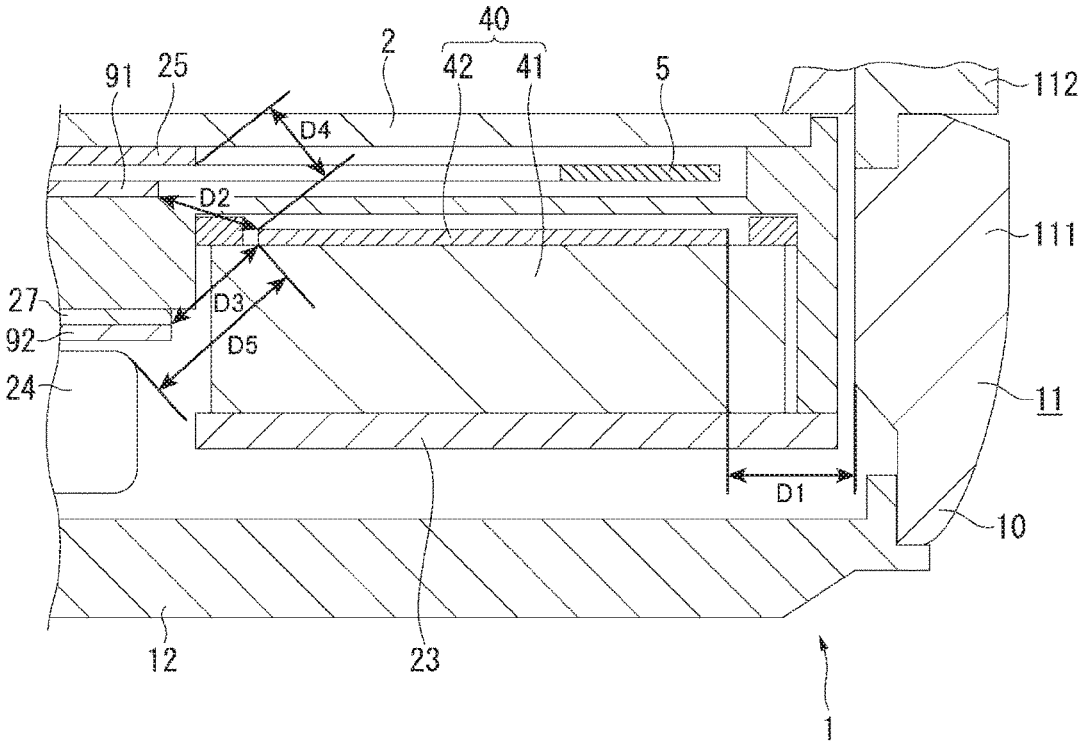
FIG. 9 describes the relative positions of the antenna electrode and metal parts of the electronic timepiece.

Because the notch 915 in the magnetic shield 91 is substantially square along the antenna electrode 42, the shortest distance D2 between the antenna electrode 42 and magnetic shield 91 is distance D2H in plan view, but because the antenna electrode 42 and the magnetic shield 91 are at different elevations in the thickness of the timepiece, shortest distance D2 is a diagonal distance as shown in FIG. 9. Note that because of similar differences in elevation, the other shortest distances D3, D4, D5 are distances D3H, D4H, D5H in plan view, but the actual shortest distances are diagonal distances D3, D4, D5 as shown in FIG. 9.

The electrode of the solar panel 25 is also on the dial side of the planar antenna 40, but because the solar panel 25 is approximately 0.1-0.2 mm thick and is thinner than the magnetic shield 91, its effect on reception sensitivity is relatively small. As a result, the shortest distance D4 between the antenna electrode 42 and the electrode of the solar panel 25 can be shorter than shortest distance D1.

Because the magnetic shield 92 is on the back cover side of the antenna electrode 42 and is a thin 0.2-0.5 mm, its effect on reception sensitivity is smaller than the case 10. Therefore, the shortest distance D3 between the antenna electrode 42 and the magnetic shield 92 can be shorter than shortest distance D1.

Note that because the storage battery 24 is somewhat thick and its location can be easily separated from the antenna electrode 42, the shortest distance D5 between the antenna electrode 42 and the storage battery 24 is set longer than shortest distance D1. In this embodiment, therefore, D1>D2, D1>D4, D1>D3, and D5>D1.

Comparing the magnetic shield 91 located closer to the crystal 31 than the antenna electrode 42 of the planar antenna 40, and the electrode of the solar panel 25, because the magnetic shield 91 is thicker, its effect on the reception sensitivity of the planar antenna 40 is greater. As a result, D2>D4 is preferable. However, because the magnetic shield 92 and storage battery 24 can be easily disposed to positions away from the antenna electrode 42, D2<D3<D5. In other words, the shortest distances to the antenna electrode 42 preferably decrease in the order D5>D1>D3>D2>D4. Note that depending on the location of the storage battery 24, D1>D5 is also conceivable.

Circuit Configuration of the Electronic Timepiece

The circuit design of the electronic timepiece 1 is described next with reference to FIG. 11.

Figure 11:
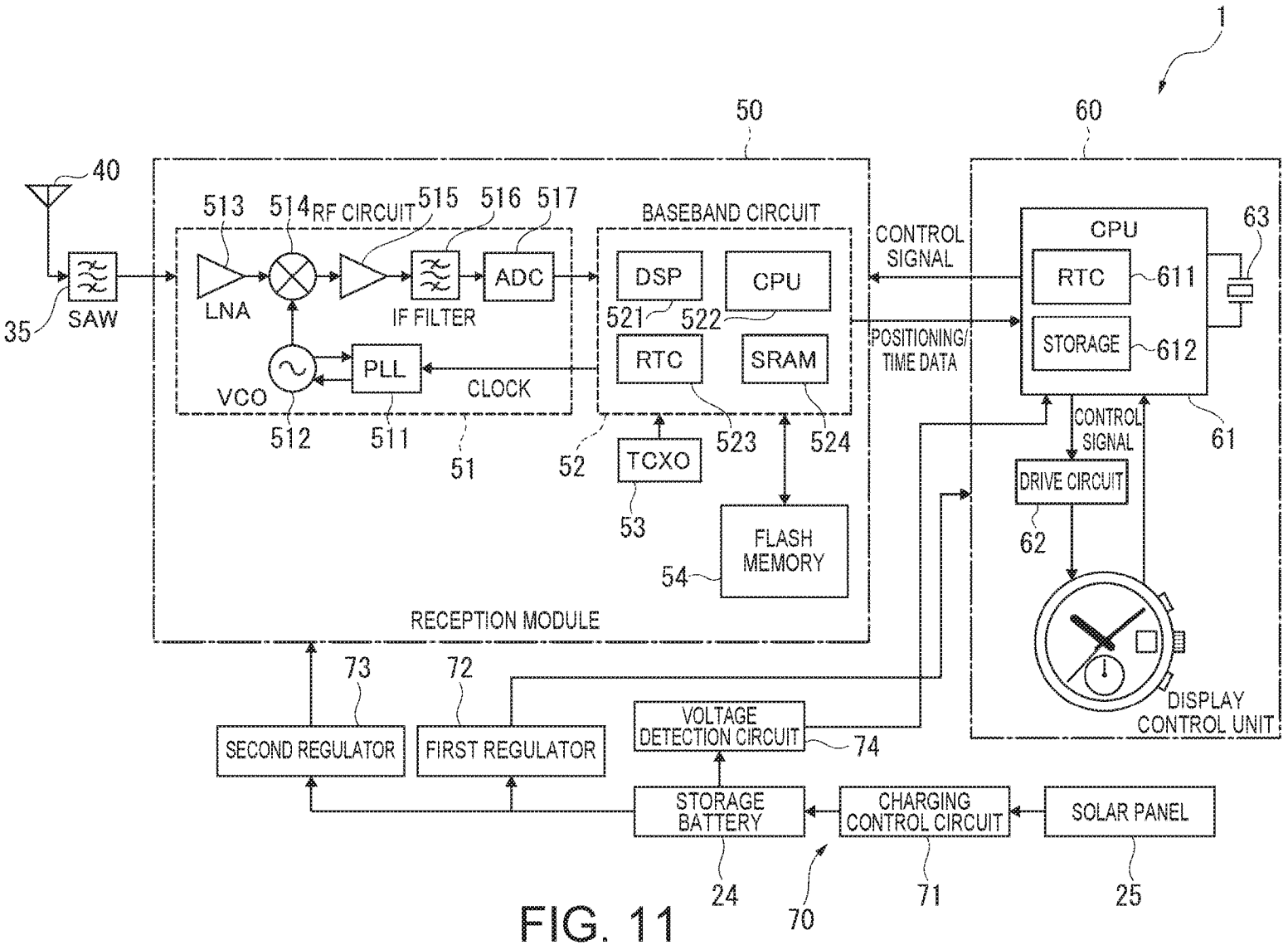
FIG. 11 is a block diagram showing the circuit configuration of the electronic timepiece.

As shown in FIG. 11, the electronic timepiece 1 has a planar antenna 40, a SAW filter 35, the reception module 50, a display control unit 60, and a power supply unit 70.

The SAW filter 35 is a bandpass filter that passes signals in the 1.5 GHz waveband. A LNA (low noise amplifier) may also be disposed between the planar antenna 40 and the SAW filter 35 to improve reception sensitivity.

Note also that the SAW filter 35 may be embedded in the reception module 50.

The reception module 50 processes satellite signals passed through the SAW filter 35, and includes an RF (radio frequency) circuit 51 and a baseband circuit 52.

The RF circuit 51 includes a PLL (phase-locked loop) circuit 511, a VCO (voltage controlled oscillator) 512, a LNA (low noise amplifier) 513, a mixer 514, an IF (intermediate frequency) amplifier 515, an IF filter 516, and an A/D converter 517.

The satellite signal passed by the SAW filter 35 is amplified by the LNA 513, mixed by the mixer 514 with the clock signal output by the VCO 512, and down-converted to a signal in the intermediate frequency band.

The IF signal from the mixer 514 is amplified by the IF amplifier 515, passed through the IF filter 516, and converted to a digital signal by the A/D converter 517.

The baseband circuit 52 includes, for example, a DSP (digital signal processor) 521, CPU (central processing unit) 522, a RTC (real-time clock) 523, and SRAM (static random access memory) 524. A TCXO (temperature compensated crystal oscillator) 53 and flash memory 54 are also connected to the baseband circuit 52.

A digital signal is input from the A/D converter 517 of the RF circuit 51 to the baseband circuit 52, which acquires satellite time information and navigation information by a correlation process and positioning computation process.

Note that the clock signal for the PLL circuit 511 is generated by the TCXO 53.

The display control unit 60 includes a control unit (CPU) 61, a drive circuit 62 that drives the hands 3, 4, a time display unit, and information display unit.

The control unit 61 includes a RTC 611 and storage 612.

The RTC 611 calculates internal time information using a reference signal output from a crystal oscillator 63.

The storage 612 stores the satellite time information and positioning information output from the reception module 50. Time difference data corresponding to the positioning information is also stored in the storage 612, and the local time at the current location can be calculated from the time difference data and the internal time kept by the RTC 611.

The electronic timepiece 1 in this example can also automatically correct the displayed time based on the satellite signals received from the GPS satellites S using the reception module 50 and display control unit 60 described above.

The power supply unit 70 includes the solar panel 25, a charging control circuit 71, the storage battery 24, a first regulator 72, a second regulator 73, and a voltage detection circuit 74.

When light is incident and the solar panel 25 produces power, the power obtained by photovoltaic generation is passed by the charging control circuit 71 to the storage battery 24 to charge the storage battery 24.

The storage battery 24 supplies drive power through the first regulator 72 to the display control unit 60, and supplies power through the second regulator 73 to the reception module 50.

The voltage detection circuit 74 monitors the voltage output of the storage battery 24, and outputs to the control unit 61. The control unit 61 can therefore know the voltage of the storage battery 24 and control the reception process.

Operating Effect

Because the shortest distance D1 from the antenna electrode 42 of the planar antenna 40 to the metal main case 11 of the electronic timepiece 1 is greater than the shortest distance D2 from the antenna electrode 42 to the magnetic shield 91, the antenna electrode 42 and metal main case 11 can be separated a relatively great distance. Because the metal main case 11 is thick in the direction through the thickness of the timepiece, the main case 11 has the greatest effect of all metal parts on the reception sensitivity of the planar antenna. Therefore, if the antenna electrode 42 can be separated from the main case 11, the drop in the reception sensitivity of the planar antenna 40 can be suppressed when a magnetic shield 91 and planar antenna 40 are housed inside the main case 11.

Furthermore, because the distance between the antenna electrode 42 and main case 11 can be increased, the top edge of the metal main case 11, that is, the top of the bezel 112, can be located closer to the top of the timepiece (crystal 31 side) than the antenna electrode 42. More specifically, because metal parts that are closer to the timepiece surface than the antenna electrode 42 affect reception sensitivity, the main case 11 must be made of plastic or other material that does not affect reception sensitivity when the distance between the antenna electrode 42 and main case 11 is short considering the directivity of the planar antenna 40. This embodiment, however, enables using a metal main case 11, and using metal for the outside case member 111 and bezel 112 of the main case 11. An electronic timepiece 1 can therefore be manufactured with a metal case, and the appearance can be improved, including imparting a luxury appearance to the timepiece design. Furthermore, because a metal case 10 has greater durability than a plastic case, the surface is more resistance to scratching and the movement 20 inside can be better protected.

Because the shortest distance D1 from the antenna electrode 42 to the main case 11 of the electronic timepiece 1 is greater than the shortest distance D4 from the antenna electrode 42 to the electrode of the solar panel 25, the effect of the main case 11 on reception sensitivity can be reduced.

Therefore, a drop in the reception sensitivity of the planar antenna 40 can be suppressed when a magnetic shield 91, solar panel 25, and planar antenna 40 are inside the main case 11.

Furthermore, because the shortest distance D2 from the antenna electrode 42 to the magnetic shield 91 in the electronic timepiece 1 is greater the shortest distance D4 from the antenna electrode 42 to the electrode of the solar panel 25, the effect of the magnetic shield 91 on reception sensitivity can be reduced. The magnetic shield 91 is thicker than the electrode of the solar panel 25, and has a greater effect than the electrode of the solar panel 25 on loss of planar antenna 40 sensitivity. Therefore, if the antenna electrode 42 is located further from the magnetic shield 91 than the electrode of the solar panel 25, the effect of the magnetic shield 91 can be reduced and loss of planar antenna 40 sensitivity can be suppressed.

Because the planar antenna 40 can be disposed without overlapping the stepper motors 221 to 224 and storage battery 24 in plan view, the planar antenna 40 can be stacked on a dielectric substrate 41. As a result, good reception performance can be assured using a planar antenna 40 with a small planar size enabling incorporation in a wristwatch size electronic timepiece 1. Furthermore, while the planar antenna 40 overlaps the dial 2 of the time display unit 9A in plan view, the reception performance of the planar antenna 40 can be assured because the dial 2 is made from a non-conductive material. The effect of the hands 3 on reception performance can also be minimized even if the hands 3 are made of a conductive material because the plane area of the hands is small.

Reception performance can therefore be assured, and a thin electronic timepiece suitable as a wristwatch can be provided.

Because the winding stem, setting lever, and other switching mechanisms are located at 3:00 on the dial 2 in plan view, the plane area of the electronic timepiece 1 must be increased if the planar antenna 40 or storage battery 24, which are relatively large compared with other timepiece parts, is disposed to the 3:00 position. Because the planar antenna 40 and storage battery 24 are not disposed at 3:00 in this embodiment, the plane size of the electronic timepiece 1 can be reduced without interfering with the layout of switching members disposed at 3:00.

Furthermore, because the storage battery 24 is located in a notch 231 in the circuit board 23, the thickness of the electronic timepiece 1 can be reduced compared with a configuration having the battery on the back side of the circuit board 23, and a thin electronic timepiece 1 can be provided.

The appearance of the electronic timepiece 1 can also be improved because part of the case 10, such as the outside case member 111, bezel 112, and back cover 12, can be metal. Furthermore, because the ring members including the dial ring 32 disposed around the outside circumference of the dial 2 are made from non-conductive materials, the planar antenna 40 can receive satellite signals passing from the crystal 31 side of the timepiece through the dial 2, dial ring 32, and base plate 21, and good reception performance can be assured even though the outside case member 111, bezel 112, and back cover 12 are metal.

Furthermore, because the subdial 2A is disposed to a position not overlapping the planar antenna 40 in plan view, metal parts can be used for the markers of the subdial 2A, for example, and the design can be improved.

Furthermore, because a shock absorber 47 is placed between the cover part 215 of the base plate 21 and the exposed surface 411 of the dielectric substrate 41, and the exposed surface 411 of the planar antenna 40 is set against the shock absorber 47, the planar antenna 40 can be precisely positioned in the thickness (height) direction of the electronic timepiece 1. As a result, the positioning precision of the planar antenna 40 to the base plate 21 can be improved, change in the antenna frequency due to deviation in positioning precision can be further reduced, and antenna performance can be further stabilized.

Furthermore, because the exposed surface 411 of the planar antenna 40 contacts the shock absorber 47, direct contact with the cover part 215 can be prevented, and damage to the ceramic dielectric substrate 41 can be prevented.

Furthermore, because the date wheel 5 is made from a non-conductive material, a drop in reception performance can be prevented even if the date wheel 5 overlaps the planar antenna 40 in part in plan view because the satellite signals can pass through the date wheel 5 to the antenna.

Furthermore, because the date wheel 5 overlaps the planar antenna 40 in plan view, there is greater freedom positioning the center pivot 3A and pivot 4A of the hands 3 and small hand 4 to avoid the date wheel 5 and planar antenna 40, and the electronic timepiece 1 can be designed with a greater degree of freedom.

Furthermore, because the planar antenna 40 does not overlap the solar panel 25 or magnetic shields 91, 92 in plan view, satellite signals passing from the face side of the timepiece are incident to the planar antenna 40 without being obstructed by the solar panel 25 or magnetic shield 91.

A solar panel 25 and magnetic shield 91 can therefore be used in the electronic timepiece 1 without reducing reception performance.

Because the planar antenna 40 does not overlap the main case 11 (outside case member 111 and bezel 112) in plan view when seen from the face of the timepiece, satellite signals pass from the face side of the timepiece through the crystal 31 and are incident to the planar antenna 40 without interference from the main case 11. Metal or other conductive material can therefore be used for the main case 11 and back cover 12 without reducing reception performance, and the apparent quality of the electronic timepiece 1 can be improved.

Furthermore, because the bezel 112 is made from a conductive material, the bezel 112 can be manufactured more easily than when using ceramic, freedom of design can therefore be improved, and cost can be reduced. Furthermore, because the bezel 112 is metal, greater rigidity can be achieved in a smaller sectional area than with a ceramic bezel. The sectional width of the ring-shaped bezel 112 can therefore be reduced, the planar size of the crystal 31 can be increased, and the freedom of timepiece design can be improved.

The outside case member 111 and back cover 12 can also function as a ground plane because they are connected to the ground of the reception module 50. The surface area of the ground plane can therefore be increased, antenna gain improved, and antenna performance improved.

Embodiment 2

Figure 12:
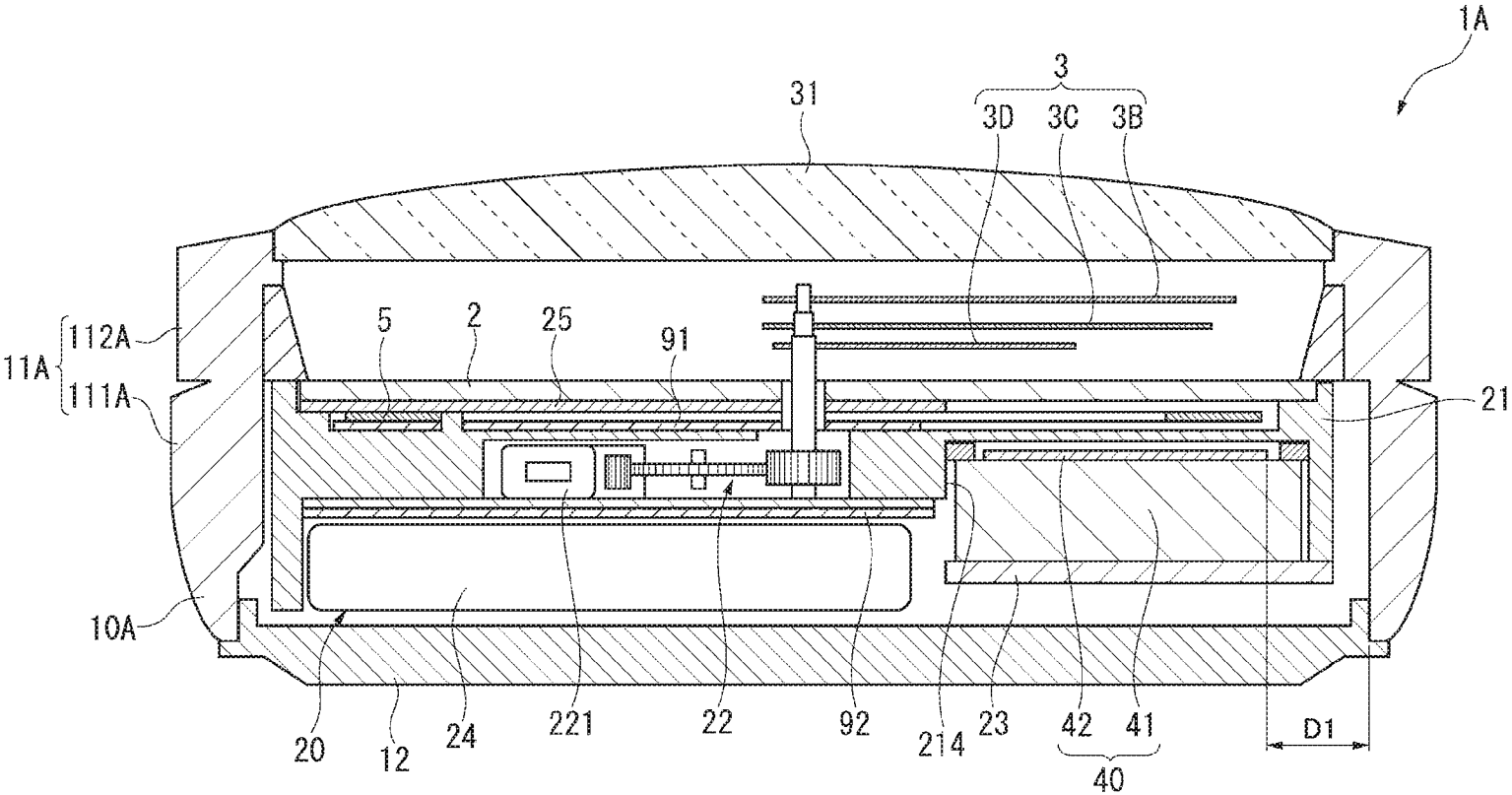
FIG. 12 is a section view of an electronic timepiece according to a second embodiment.

A second embodiment is described next with reference to FIG. 12. Note that like parts in the second embodiment and the first embodiment are identified by like reference numerals, and further description thereof is omitted.

The case 10A of an electronic timepiece 1A according to a second embodiment uses a metal main case 11A with the outside case member 111A and bezel 112A formed in unison. To increase the shortest distance between the antenna electrode 42 of the planar antenna 40 and the inside surface of the case 10A, a portion of the inside surface of the case 10A is removed only in the area near the planar antenna 40. As a result, the thickness of the main case 11A close to the planar antenna 40 on the right side in the figure is thinner than the thickness of the main case 11A on the left side in the figure. Note that other parts are the same as in the first embodiment, and further description thereof is omitted.

Because the outside case member 111A and bezel 112A are formed in unison in the electronic timepiece 1A according to the second embodiment, the number of parts in the electronic timepiece 1A can be reduced and the cost can be reduced.

Furthermore, shortest distance D1 can be increased because the inside surface of the case 10A is removed in the area near the planar antenna 40. The planar antenna 40 can therefore be further separated from the main case 11A, the reception sensitivity of the planar antenna 40 can be improved, and satellite signal reception performance can be improved.

Embodiment 3

Figure 13:
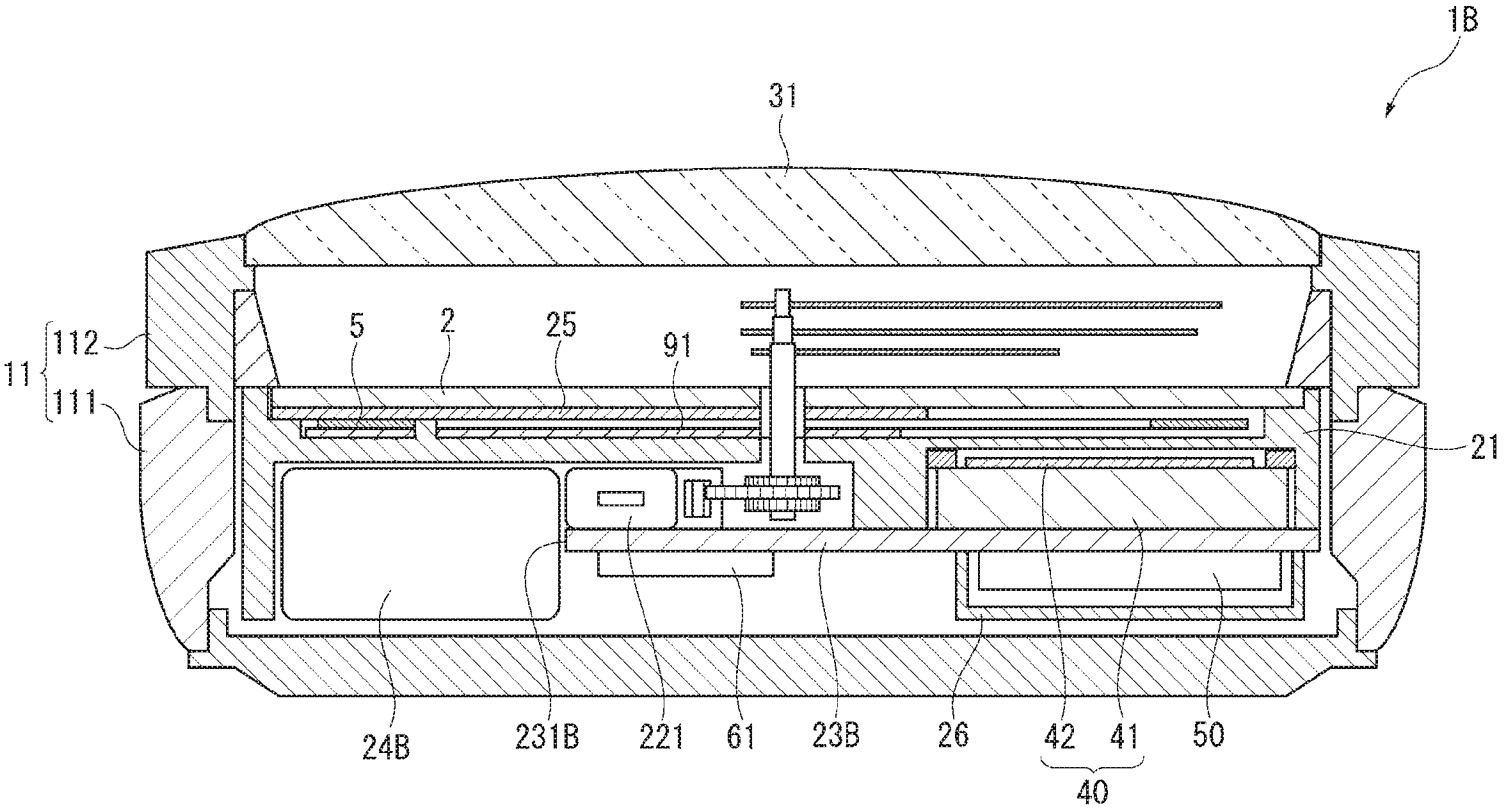
FIG. 13 is a section view of an electronic timepiece according to a third embodiment.

A third embodiment is described next with reference to FIG. 13. It should be noted that identical or similar parts in this and the first embodiment are identified by like reference numerals, and further description thereof is omitted below.

The electronic timepiece 1B according to the third embodiment uses a storage battery 24B with a smaller plane area than the storage battery 24 in the first embodiment. More specifically, the diameter of the storage battery 24 in the first embodiment is greater than the radius of the base plate 21 of the movement 20 as shown in FIG. 2 to FIG. 5. The diameter of the storage battery 24B in the third embodiment is smaller than the radius of the base plate 21 of the movement 20 as shown in FIG. 13.

As a result, while the storage battery 24 in the first embodiment is a lithium coin battery 20 mm in diameter and 1.6 mm thick, the storage battery 24B of the third embodiment is a lithium battery 9 mm in diameter and 3.7 mm thick.

The electronic timepiece 1B uses a storage battery 24B with a small plane area, and the storage battery 24B is disposed where it is not superimposed with the planar antenna 40, the stepper motors 221 to 224, or the wheel train.

The circuit board 23B is a single board, and the reception module 50 (GPS chip) and control unit 61 (timepiece control chip) are mounted on the single circuit board 23B. The reception module 50 is on the back side of the circuit board 23B, and is surrounded by a shield 26.

The electronic timepiece 1B also has magnetic shields 91, 92. Note that magnetic shield 92 is not shown in FIG. 13, but is disposed to the back cover 12 side of the wheel train bridge 27 as in the electronic timepiece 1 of the first embodiment.

As a result, the shortest distances D1 to D5 between the dielectric substrate 41 and the case 10, magnetic shield 91, magnetic shield 92, electrode of the solar panel 25, and storage battery 24B, respectively, is D5>D1>D3>D2>D4 as in the first embodiment.

The notch 231B in the circuit board 23B of the electronic timepiece 1B according to the third embodiment can be smaller than in the first embodiment by using a small diameter storage battery 24B. As a result, the area of the circuit board 23B is greater than the foregoing circuit board 23, there is greater freedom of design in the wiring pattern, and an ideal pattern can be designed. In addition, because the ground area of the circuit board 23B also increases, the reception performance of the planar antenna 40 can be improved.

Furthermore, because the plane area of the storage battery 24B is small, the planar antenna 40, first stepper motor 221 to fourth stepper motor 224, and the first wheel train 226 to fourth wheel train can be arranged in the movement 20 without overlapping in plan view.

A storage battery 24B with a small diameter can also be disposed separated from the planar antenna 40. As a result, the storage battery 24B can be located to a position separated from the feed pin, and its effect on reception sensitivity can be suppressed.

Furthermore, while the thickness of a high output storage battery such as a lithium ion coin battery increases with age, because the storage battery 24B is not superimposed with the wheel train and other parts in plan view, an increase in battery thickness does not affect the operation of other parts.

Embodiment 4

A fourth embodiment is described next with reference to FIG. 14 to FIG. 18. It should be noted that identical or similar parts in this and the foregoings embodiment are identified by like reference numerals, and further description thereof is omitted below.

Figure 14:
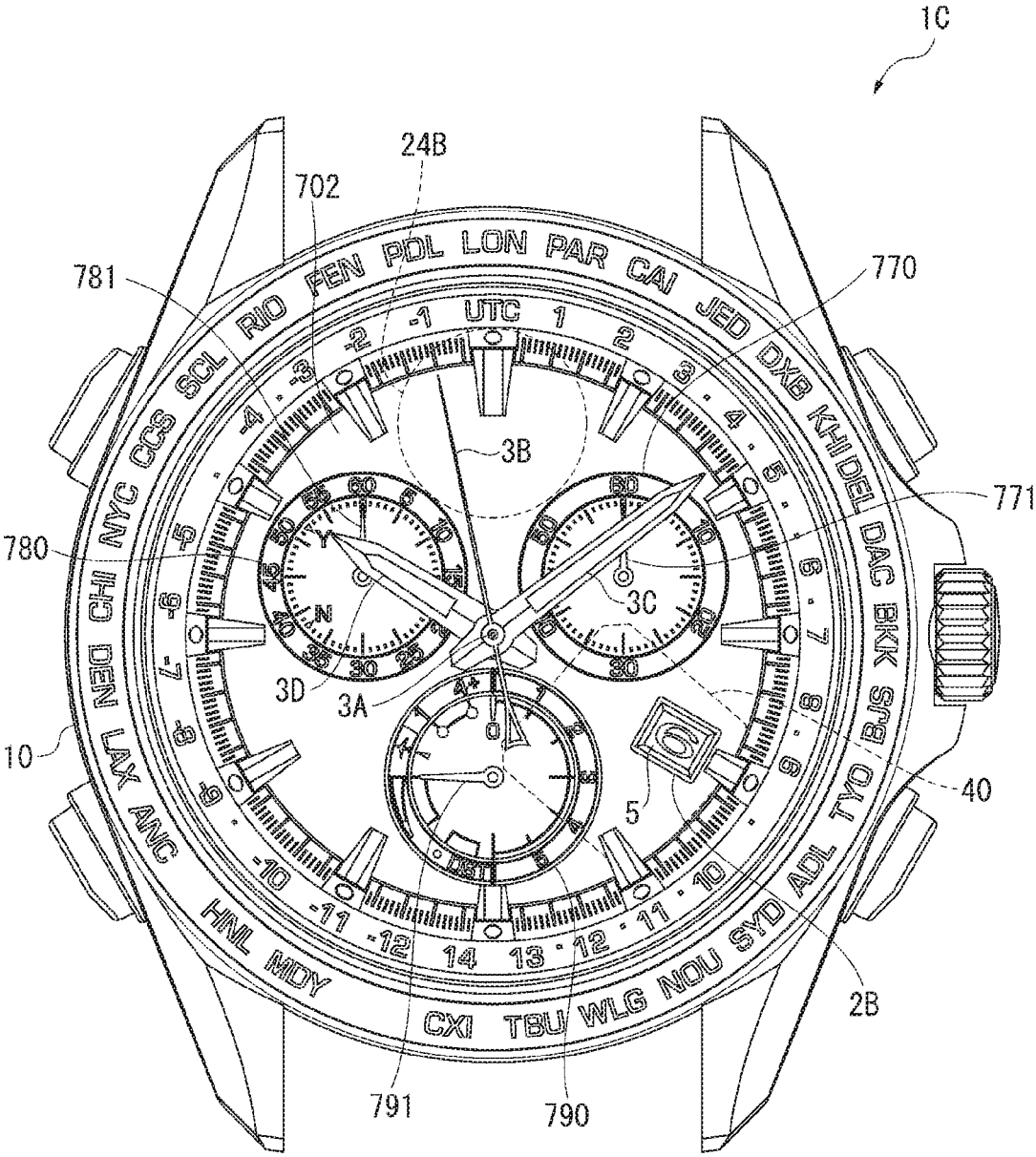
FIG. 14 is a section view of an electronic timepiece according to a fourth embodiment.

As shown in FIG. 14, an electronic timepiece 1C according to the fourth embodiment has a dial 702 with three windows (subdials). As in the foregoing embodiments, a center pivot 3A is disposed in the plane center of the dial 702, and a second hand 3B, minute hand 3C, and hour hand 3D are mounted on the center pivot 3A. A round first window 770 and hand 771 are disposed at 2:00; a second window 780 and hand 781 are disposed at 10:00; a third window 790 and hand 791 are disposed at 6:00; and a rectangular date window 2B at 4:00. A date wheel 5 is located on the back side of the dial 702, and the date wheel 5 can be seen through the date window 2B.

In this embodiment the hand 771 of the first window 770 is a chronograph minute hand, and the hand 781 of the second window 780 is a chronograph 1/5 second hand. The hand 791 of the third window 790 is used as both a mode indicator and a chronograph hour hand. When used as a mode indicator, the hand 791 indicates particular settings in different modes, including the summer time setting (DST=daylight saving time, O=standard time (DST is off)); is used as a power indicator indicating the reserve power of the storage battery 24B; indicates if the in-flight mode is enabled; and indicates whether the timekeeping mode for receiving GPS time information and adjusting the internal time, or the positioning mode for receiving GPS time information and orbit information and correcting the internal time and time zone setting, is active.

As shown in FIG. 14, the planar antenna 40, which is a patch antenna, in this electronic timepiece 1C is between the center pivot 3A and case 10, and from 4:00 to 5:00 on the dial 702. As a result, the planar antenna 40 and date window 2B do not overlap in plan view.

Note that the planar antenna 40 partially overlaps the first window 770 and third window 790. As a result, to improve the reception sensitivity of the planar antenna 40, the first window 770 and third window 790 are preferably made of plastic or other non-conductive material instead of metal. Metal parts can be used for the second window 780 not overlapping the planar antenna 40 in plan view, but plastic or other non-conductive material is preferably used to unify the appearance with the other first window 770 and third window 790.

This electronic timepiece 1C also uses the same storage battery 24B with a small plane area that is used in the third embodiment described above. In a plan view of the electronic timepiece 1C, the storage battery 24B is preferably located at 12:00 on the dial, that is, in the area from 11:00 through 12:00 to 1:00.

Figure 15:
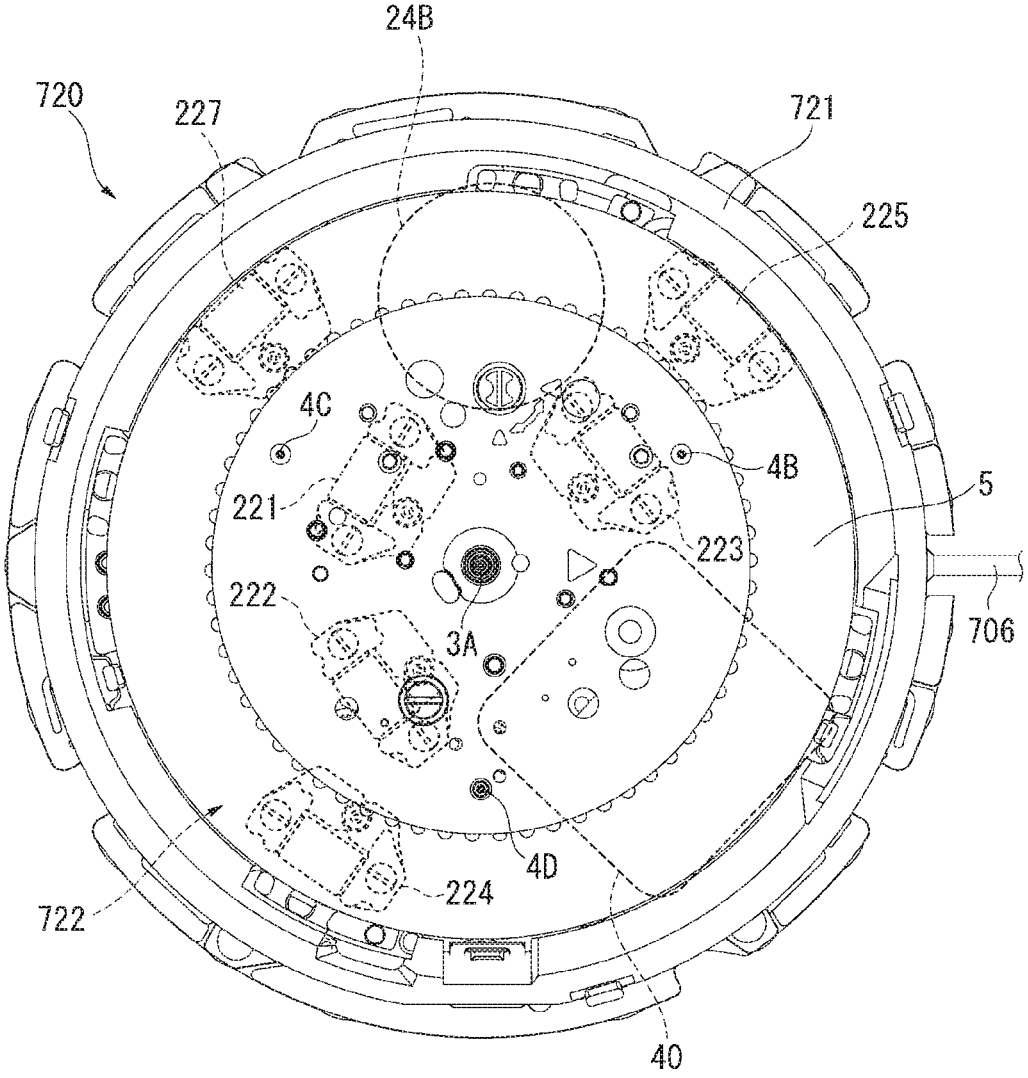
FIG. 15 is a plan view showing main parts of the movement of an electronic timepiece according to the fourth embodiment.

FIG. 15 is a basic plan view of the movement 720. The movement 720 has a base plate 721, and a drive module 722 is disposed to the base plate 721. As in the foregoing embodiments, the drive module 722 includes a stepper motor 221 and first wheel train 226 for driving the hands 3 (FIG. 16); a second stepper motor 222 and second wheel train (not shown in the figure) for driving the minute hand 3C; a third stepper motor 223 and third wheel train (not shown in the figure) for driving the hour hand 3D; and a fourth stepper motor 224 and fourth wheel train (not shown in the figure) that are used to drive both hand 791 and the date wheel 5. The fourth wheel train has a date indicator driving wheel 228 (FIG. 18) for turning the date wheel 5.

The movement 720 of this electronic timepiece 1C also includes a fifth stepper motor 225 and fifth wheel train (not shown in the figure), and a sixth stepper motor 227 and sixth wheel train (not shown in the figure) for driving hand 781.

The stepper motors 221 to 225, 227 are disposed to positions not superimposed in plan view with the planar antenna 40 and storage battery 24B. More specifically, in relation to the center pivot 3A in the plane center of the base plate 721, the stepper motor 221 is at approximately 10:00, the second stepper motor 222 is at approximately 7:00, and the third stepper motor 223 is at approximately 2:00.

The fourth stepper motor 224 is at approximately 7:00 relative to the center pivot 3A, and is closer to the outside circumference of the timepiece than the second stepper motor 222 at a position overlapping the date wheel 5 in plan view.

The fifth stepper motor 225 is between 1:00 and 2:00 relative to the center pivot 3A, and is closer to the outside circumference of the timepiece than the third stepper motor 223 at a position overlapping the date wheel 5 in plan view.

The sixth stepper motor 227 is between approximately 10:00 and 11:00 from the center pivot 3A, and is closer to the outside circumference of the timepiece than the stepper motor 221 at a position overlapping the date wheel 5 in plan view.

Of the center hands, that is, the second hand 3B, minute hand 3C, and hour hand 3D, the second hand 3B is longest, the hour hand 3D is shortest, and the movement period (drive period) of the second hand 3B is shortest and the hour hand 3D is longest. As a result, the stepper motor 221 is preferably a motor with the greatest output torque, that is, is the largest motor. Because the output torque of the third stepper motor 223 may be less than the other stepper motors 221, 222, the third stepper motor 223 may also be smaller. As a result, the third stepper motor 223 is located in the electronic timepiece 1C near 2:00, which is between the storage battery 24B and the planar antenna 40 where space is difficult to create around the center pivot 3A, and the stepper motors 221, 222 are placed in the area from 7:00 to 10:00 where a large space is available.

The pivot 4B to which hand 771 is attached is on the outside circumference side of the third stepper motor 223 and on the inside circumference side of the date wheel 5. The hand 4C to which hand 781 is attached is on the outside circumference side of the first stepper motor 221 and on the inside circumference side of the date wheel 5. The hand 4D to which hand 791 is attached is near the second stepper motor 222 on the inside circumference side of the date wheel 5.

Also in the movement 720, the winding stem 706 that connects to the crown 6 is at 3:00 on the dial 702 in plan view, and the setting lever or other switching mechanisms (selector mechanisms), are arranged around the winding stem 706.

Figure 16:
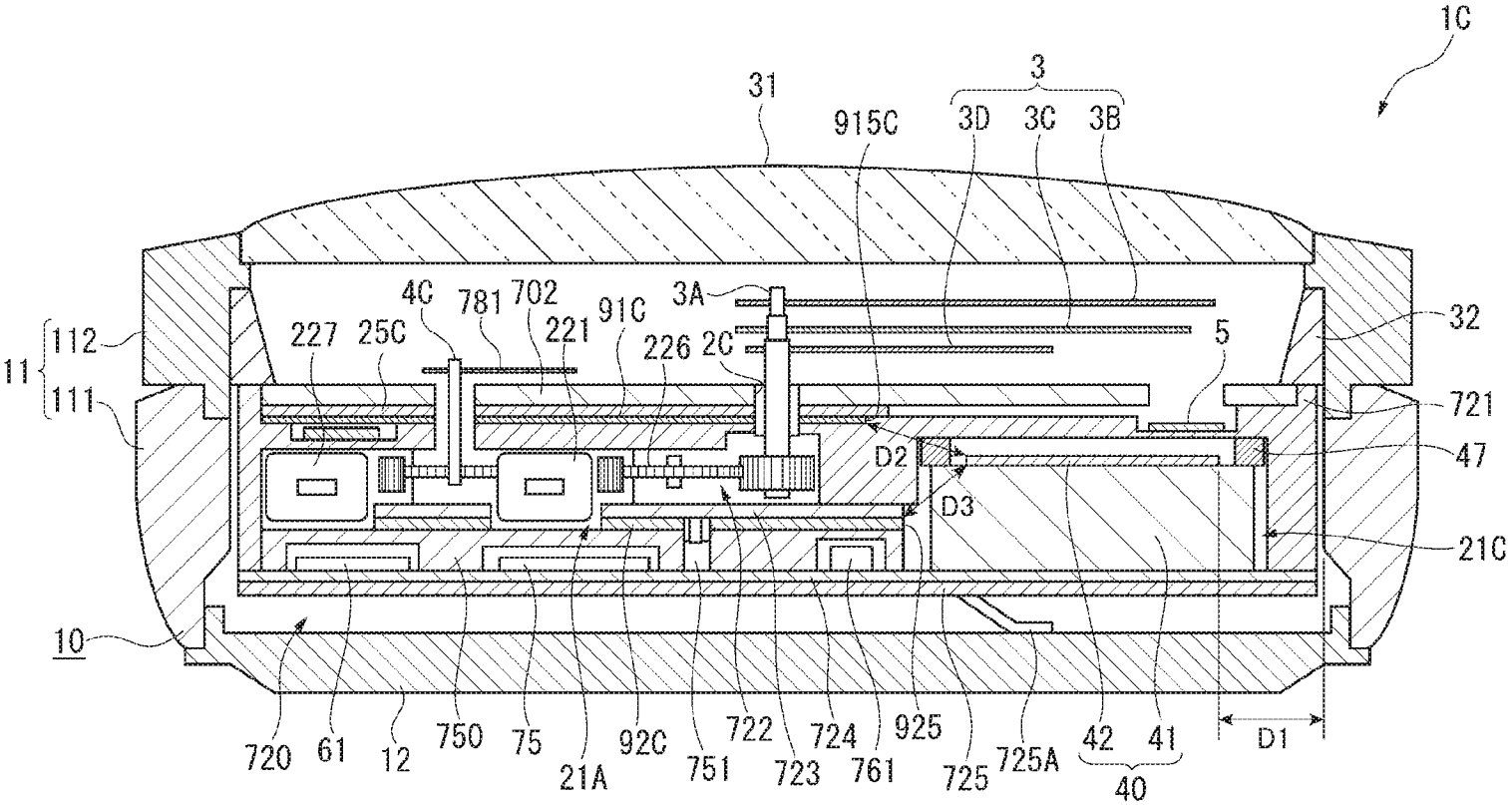
FIG. 16 is a section view of an electronic timepiece according to the fourth embodiment.
Figure 17:
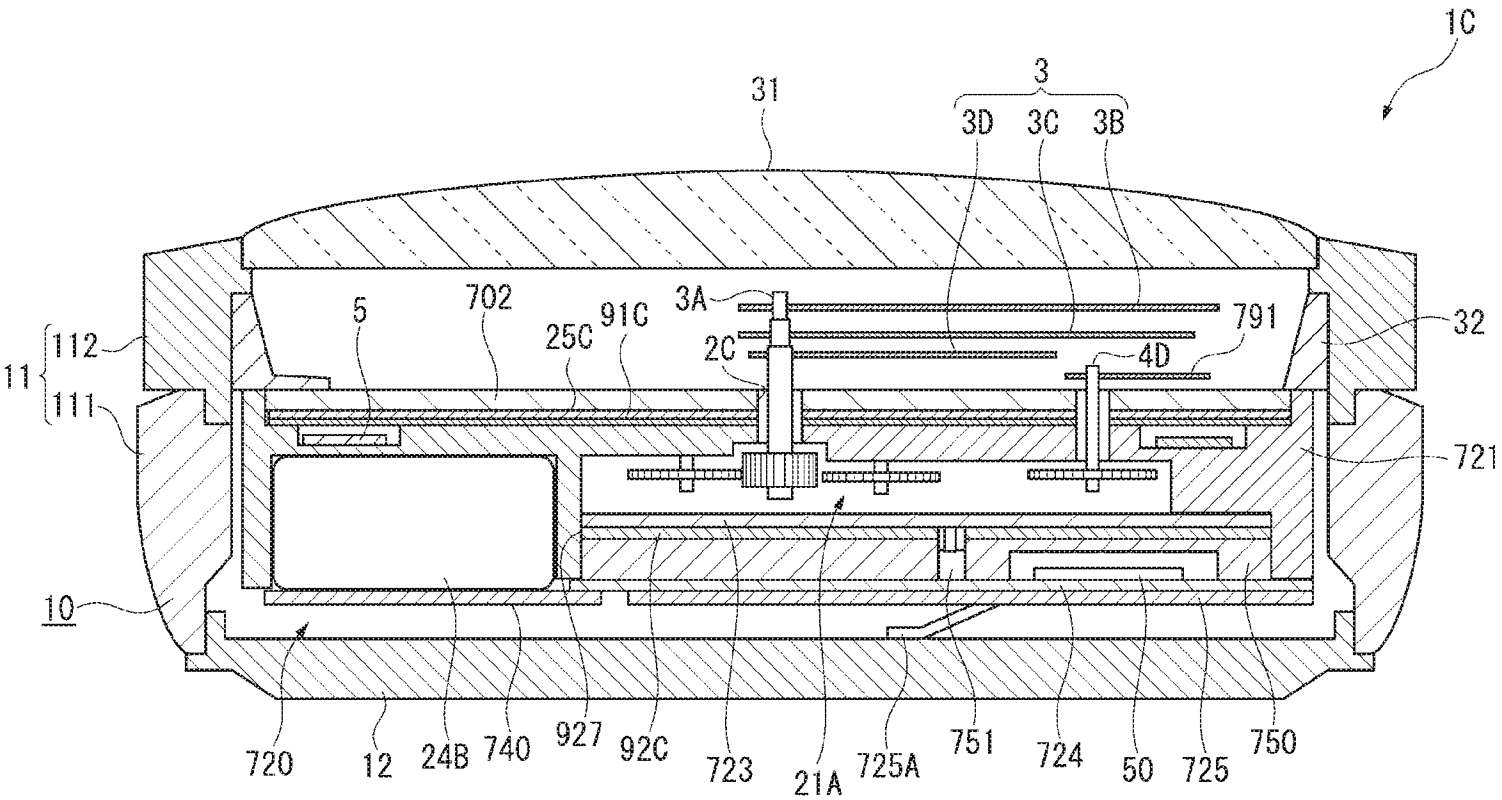
FIG. 17 is a section view of an electronic timepiece according to the fourth embodiment.
Figure 18:
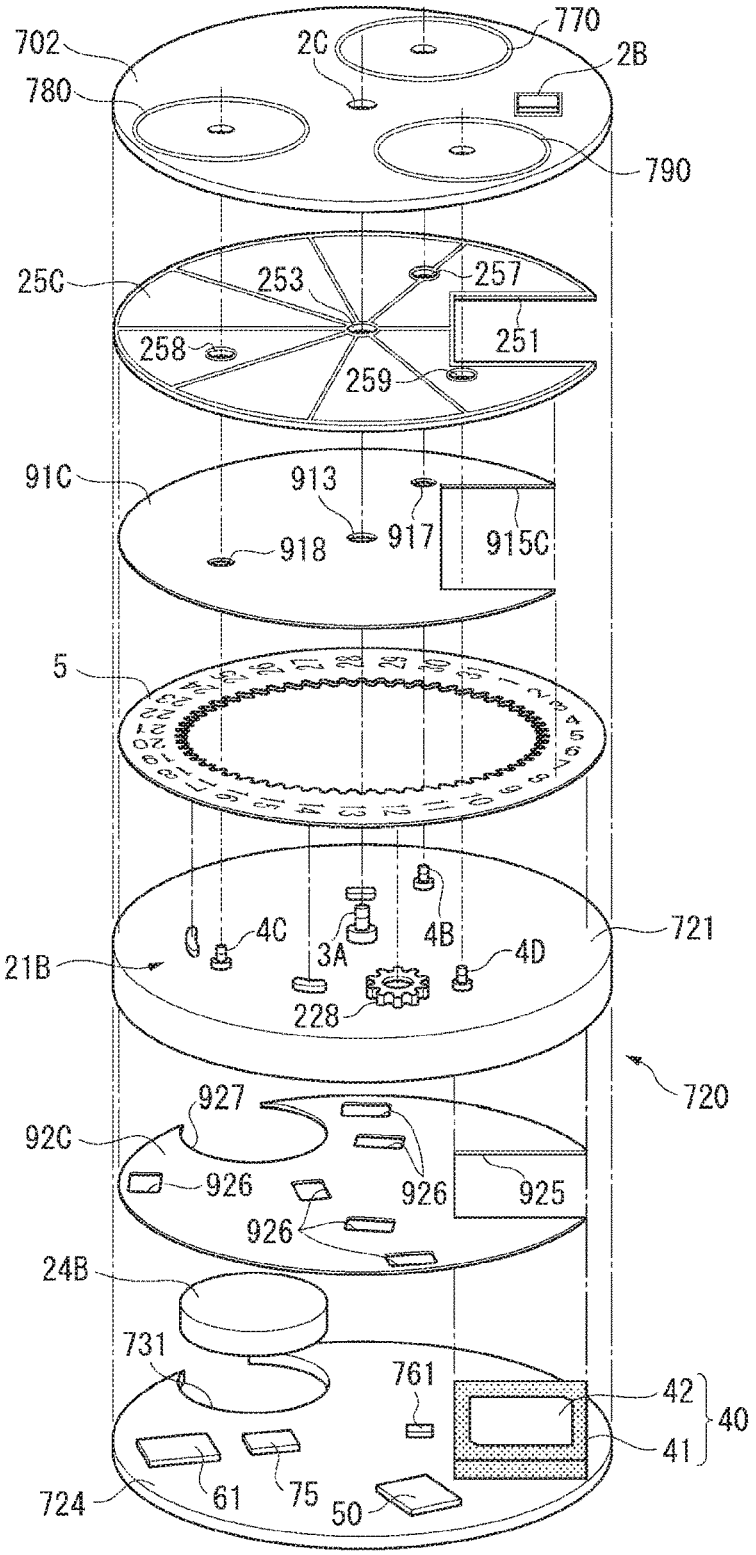
FIG. 18 is a partially exploded oblique view of an electronic timepiece according to the fourth embodiment.

The internal structures inside the case 10 of the electronic timepiece 1C are described next in detail with reference to FIG. 16 to FIG. 18. FIG. 16 is a section view on a line through 4:00 and 10:00 on the dial 702, and FIG. 17 is, like FIG. 3, a section view on a line through 12:00 and 6:00 on the dial 702. FIG. 18 is a partially exploded oblique view like FIG. 4. Note that like parts in this and the foregoing embodiments are identified by like reference numerals in FIG. 16 to FIG. 18.

As shown in FIG. 16 and FIG. 17, a dial 702, movement 720, planar antenna 40 (patch antenna), date wheel 5, and dial ring 32 are housed inside the case 10.

The movement 720 includes a base plate 721, a wheel train bridge (not shown in the figure), a drive module 722 supported by the base plate 721 and wheel train bridge, a first circuit board 723, a second circuit board 724, the storage battery 24B, a solar panel 25C, and a first magnetic shield 91C, and a second magnetic shield 92C.

As shown in FIG. 18, the solar panel 25C is on the back side of the dial 702.

The solar panel 25C is similar to the solar panel 25 in the foregoing embodiments, but in this embodiment is divided into eight solar cells connected in series. As in the above embodiments, each solar cell has substantially the same generating capacity. Therefore, if one solar cell produces approximately 0.6 V or more, the solar panel 25 produces approximately 0.6 V×8=approximately 4.8 V or more by connecting the eight solar cells in series.

A notch 251 is formed in the solar panel 25C at the position superimposed with the planar antenna 40 in plan view, and holes 253, 257, 258, 259 through which the pivots 3A, 4B, 4C, 4D of the hands pass are also formed. Note that because the date window 2B is superimposed with the notch 251 in plan view, there is no need to provide a hole in the solar panel 25C corresponding to opening 252 in the solar panel 25 described above.

The first magnetic shield 91C is disposed on the back side of the solar panel 25C above (on the dial 702 side of) the stepper motors 221-225, 227 of the drive module 722. The first magnetic shield 91C has a notch 915C cut out in the area overlapping the planar antenna 40 in plan view. This notch 915C is larger than the notch 925 in the second magnetic shield 92C, and is larger than the notch 915 in the magnetic shield 91 in the foregoing embodiments. As a result, the notch 915C is also superimposed with the date window 2B and the hole 259 through which the hand 4D passes. Apertures 913, 917, 918 through which the pivots 3A, 4B, 4C pass are also formed in the first magnetic shield 91C.

The date wheel 5 is located on the back side of the first magnetic shield 91C. The date wheel 5 can be seen in the date window 2B through the notch 915C and the notch 251.

The base plate 721 is on the back side of the date wheel 5. As in the base plate 21 in the embodiments described above, a drive module housing 21A (FIG. 16, FIG. 17), date wheel housing 21B (FIG. 18), and antenna housing 21C (FIG. 16) are disposed to the base plate 721.

The placement of the planar antenna 40 in the antenna housing 21C, and the configuration of the planar antenna 40, are the same as in the preceding embodiments, and further description thereof is omitted.

A wheel train bridge not shown in the figures is disposed on the back side of the base plate 721. The wheel train bridge has a bridge for each wheel train, and is disposed appropriately to the locations of the wheel trains.

The first circuit board 723 (not shown in FIG. 18) and the second magnetic shield 92C are disposed to the back side of the wheel train bridge.

The first circuit board 723 includes lines having continuity with the coils of the stepper motors 221-225, 227 and is connected to the second circuit board 724 through a connector 751. Two connectors 751 for conductivity to both ends of the coil are disposed to one stepper motor. Because there are six stepper motors in this embodiment, holes (not shown in the figure) accommodating the connectors 751 are formed in the second magnetic shield 92C.

A notch 925 is formed in the second magnetic shield 92C to avoid interference with the planar antenna 40. The areas of the first circuit board 723 and second magnetic shield 92C corresponding to the coils of the stepper motors 221-225, 227 are also removed, forming appropriate apertures. For example, as shown in FIG. 18, six holes 926 in which the coils are disposed are formed in the second magnetic shield 92C.

The coils of the stepper motors 221-225, 227, the first circuit board 723, and the second magnetic shield 92C therefore do not overlap in plan view, and the thickness of the movement 720 can be reduced by placing the coils in the holes 926.

The first circuit board 723 and second magnetic shield 92C are also disposed to not interfere with the storage battery 24B. As a result, as shown in FIG. 18, a notch 927 that is round in plan view is formed in the second magnetic shield 92C.

The second circuit board 724 is disposed to the back of the second magnetic shield 92C with a spacer 750 (not shown in FIG. 18) therebetween.

As shown in FIG. 18, a substantially round notch 731 in which the storage battery 24B is disposed and which is basically round in plan view is formed in the second circuit board 724. By placing the storage battery 24B in the notch 731, the thickness of the electronic timepiece 1C can be reduced. The planar antenna 40 (patch antenna) is disposed on the dial side of the second circuit board 724. Also disposed to the dial side of the second circuit board 724 are the reception module 50 (receiver chip, GPS module) that processes satellite signals received from GPS satellites, semiconductor chip 761, the control chip (timepiece control chip 61) that controls driving the motors, a power supply chip 75, and a memory chip (not shown in the figure).

The spacer 750 protects the IC chips. The chips are disposed at positions at least not directly below the pivots 3A, 4B, 4C, 4D. The second circuit board 724 is therefore disposed below the pivots 3A, 4B, 4C, 4D with the spacer 750 therebetween and no semiconductor chips or devices directly below the pivots 3A, 4B, 4C, 4D. A circuit cover 725 is also disposed on the back side of the second circuit board 724.

As a result, the force of pushing the hands 3 (second hand 3B, minute hand 3C, hour hand 3D), and hands 771, 781, 791 onto the pivots 3A, 4B, 4C, 4D is borne by the circuit cover 725 through the wheel train bridge, first circuit board 723, second magnetic shield 92C, spacer 750, and second circuit board 724.

A back cover lead spring 725A for conductivity to the back cover 12 is formed in unison with the circuit cover 725. Plural back cover lead springs 725A are disposed to the circuit cover 725.

A battery terminal connector 740 is disposed to the back cover side of the storage battery 24B as shown in FIG. 17, and the battery terminal connector 740 is conductive to the second circuit board 724. While not shown in the figures, the solar panel 25C is conductive to the second circuit board 724, and is configured so that power produced by the solar panel 25C can charge the storage battery 24B through the second circuit board 724.

Also in this electronic timepiece 1C, as shown in FIG. 16, the shortest distance between the antenna electrode 42 of the planar antenna 40 and main case 11 is D1; the shortest distance between the antenna electrode 42 and the first magnetic shield 91C disposed on the back of the dial 702 is D2; and the shortest distance to the second magnetic shield 92C on the back side of the first circuit board 723 is D3.

As described above, because the planar antenna 40 has strong directivity toward the zenith (the direction toward the crystal 31), the reception sensitivity of the planar antenna 40 is easily affected by the case 10, which is the thickest of the metal parts and is located closer to the face of the timepiece than the planar antenna 40. As a result, the shortest distance D1 between the antenna electrode 42 of the planar antenna 40 and the case 10 must be increased to sufficiently separate the antenna electrode 42 from the case 10.

Because the first magnetic shield 91C and the second magnetic shield 92C are metal, they absorb radio waves and interfere with reception by the planar antenna 40. As a result, reception performance can be improved by separating the first magnetic shield 91C and second magnetic shield 92C from the planar antenna 40. However, to improve the magnetic resistance of the electronic timepiece 1C, the first magnetic shield 91C and second magnetic shield 92C preferably cover the largest possible area.

Comparing the first magnetic shield 91C and the second magnetic shield 92C, the first magnetic shield 91C located on the crystal 31 side of the antenna electrode 42 has a greater effect on reception. As a result, by making the area of the notch 915C in the first magnetic shield 91C larger than the notch 925 in the second magnetic shield 92C, the shortest distance D2 between the antenna electrode 42 and the first magnetic shield 91C is greater than the shortest distance D3 between the antenna electrode 42 and the second magnetic shield 92C (D2>D3). In this embodiment, therefore, D1>D2>D3.

Because the shortest distance D2 between the antenna electrode 42 and the first magnetic shield 91C is greater than the shortest distance D3 between the antenna electrode 42 and the second magnetic shield 92C in the electronic timepiece 1C according to the fourth embodiment, a drop in reception performance can be prevented because the first magnetic shield 91C that is above (on the crystal 31 side of) the antenna electrode 42 and easily affects reception performance can be separated from the antenna electrode 42. Furthermore, because the shortest distance D3 between the antenna electrode 42 and the second magnetic shield 92C located below (on the back cover 12 side of) the antenna electrode 42 is less than shortest distance D2, the area of the second magnetic shield 92C can be increased and magnetic resistance can be improved. Reception performance can therefore be balanced with magnetic resistance, and a small electronic timepiece 1C can be achieved.

Furthermore, because the shortest distance D1 between the antenna electrode 42 and case 10 is greater than the shortest distances D2, D3 between the antenna electrode 42 and magnetic shields 91C, 92C, the effect of the case 10 on reception performance can be reduced and desirable reception performance can be assured.

Furthermore, because a small diameter storage battery 24B is used, the same effect as the third embodiment is achieved. For example, the wiring patterns on the first circuit board 723 and second circuit board 724 can be designed more freely and an ideal pattern can be designed. As a result, the six stepper motors 221-225, 227 can be desirably arranged, and a multi-hand, multifunction timepiece capable of independently driving all of the hands 3 (second hand 3B, minute hand 3C, hour hand 3D), 771, 781, 791 can be easily produced.

Furthermore, because the ground area of the second circuit board 724 also increases, the reception performance of the planar antenna 40 can be improved. The storage battery 24B, planar antenna 40, stepper motors 221-225, 227, and wheel trains can also be arranged without overlapping in plan view, and a thin electronic timepiece 1C can be achieved.

The circuit board includes two parts, a first circuit board 723 and a second circuit board 724, and the lines that connect to the coils of the stepper motors 221-225, 227 are formed on the first circuit board 723 and connect to the second circuit board 724 populated with IC chips and devices through a connector 751. As a result, when the number of hands changes, or the locations of the stepper motors 221-225, 227 change, the same second circuit board 724 can still be used while replacing only the first circuit board 723 with a compatible circuit board. Changes in the number of hands and layout can therefore be easily accommodated.

Because a plastic spacer 750 shaped to not interfere with chips and devices on the second circuit board 724 is disposed between the first circuit board 723 and the second circuit board 724, when the hands 3, 771, 781, 791 are pushed onto the pivots 3A, 4B, 4C, 4D, the force applied from the pivots 3A, 4B, 4C, 4D through the wheel train to the first circuit board 723 and second magnetic shield 92C can be supported through the spacer 750 by metal parts such as the second circuit board 724 and the circuit cover 725. Compressive force from pushing the hands onto the pivots can therefore be supported by high strength metal parts, and the hands can be consistently and reliably installed.

Furthermore, because aback cover lead spring 725A rendered by processing the circuit cover 725 has continuity with the metal back cover 12, the back cover 12 can be used as a ground, and electrostatic resistance and reception performance can be improved. More particularly, because there are plural back cover lead springs 725A in this embodiment, the back cover 12 can be reliably used as ground, and electrostatic resistance and reception performance can be improved.

Other Embodiments

The invention is not limited to the foregoing embodiments, and can be varied in many ways without departing from the scope of the accompanying claims.

Figure 19:
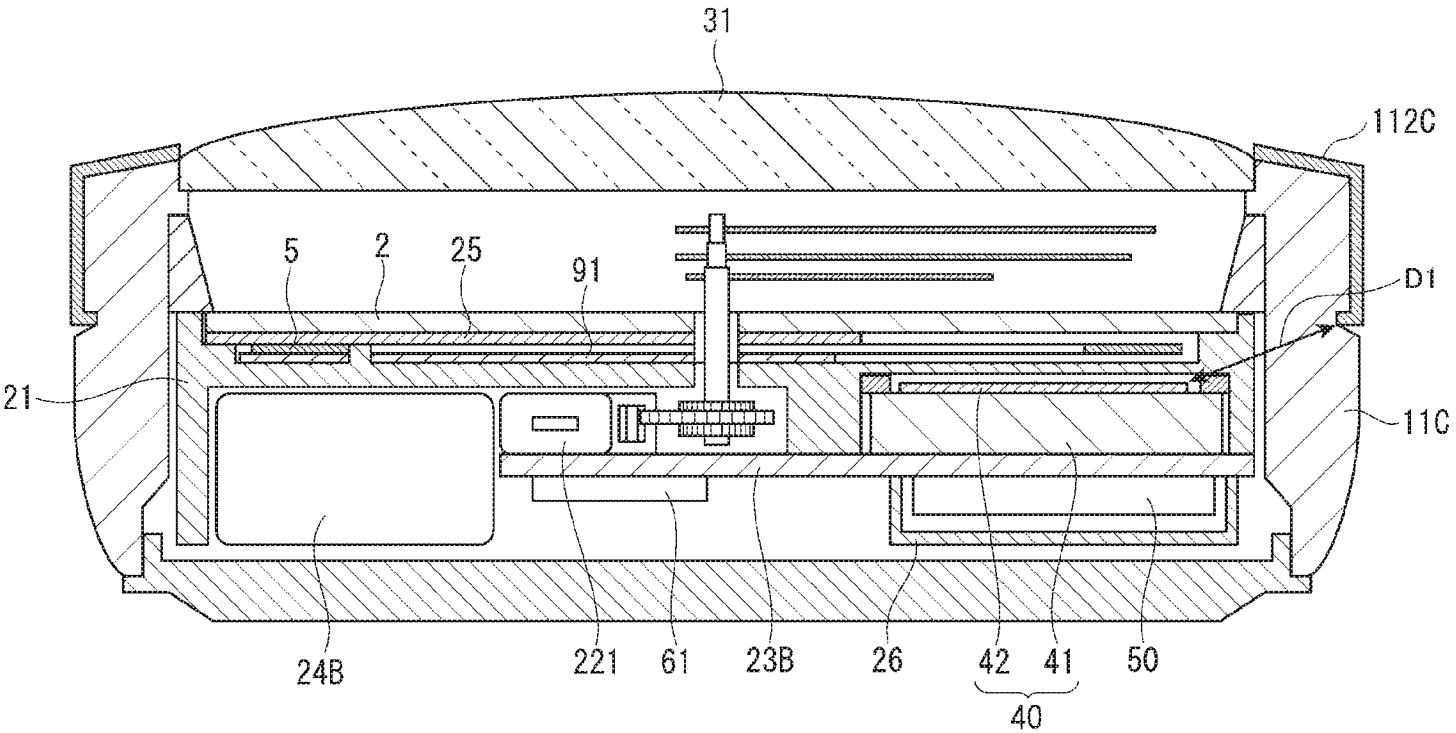
FIG. 19 is a section view of an electronic timepiece according to another embodiment.

For example, as shown in FIG. 19, a metal bezel cover 112C may be affixed to a plastic main case 11C as the outside case of the electronic timepiece. In this configuration, the bezel cover 112C is a metal part of the case. Thus comprised, the reception performance of the planar antenna 40 can be improved because the shortest distance D1 between the antenna electrode 42 and the bezel cover 112C that is the metal part of the case can be increased.

The configurations of the planar antenna and circuit boards are not limited to the embodiments described above. For example, the planar antenna 40 may be formed with the antenna electrode 42 formed on the surface of the dielectric substrate 41 offset in the direction away from the main case 11.

By thus disposing the antenna electrode 42 of the planar antenna 40 away from the metal outside case member 111, the shortest distance D1 can be increased, and signal blocking effect of the metal outside case member 111 can be reduced.

In the embodiments described above, the shortest distance D5 between the antenna electrode 42 and the storage battery 24, 24B is set greater than the shortest distance D1 between the antenna electrode 42 and the main case 11 (D1<D5) by using a flat storage battery 24 and disposing the storage battery 24 at a different elevation than the antenna electrode 42, or using a small diameter storage battery 24B to separate the storage battery 24B from the antenna electrode 42 in the plane direction, but depending on the arrangement of the storage battery 24, 24B, configurations in which D1>D5 are also conceivable. In this event, because the antenna electrode 42 of the planar antenna 40 can be separated from the metal case members (main case 11), the effect of the metal case 10 on reception performance can be reduced. The storage battery 24, 24B is thinner than the case 10, and the location of the battery in the thickness direction of the timepiece is generally closer to the back cover 12 than the antenna electrode 42. As a result, the effect of the battery on the reception performance of the planar antenna 40 is less than the case 10. Therefore, if the antenna electrode 42 of the planar antenna 40 is separated from the case 10 more than the storage battery 24, 24B so that D1>D5, suppressing a drop in the sensitivity of the planar antenna is easier than if D1<D5.

The bezel 112 in the foregoing embodiments is made from a conductive material, but the invention is not so limited. For example, the bezel 112 may be made from a non-conductive material such as zirconia (ZrO2) or other ceramic. Zirconia not only has high resistivity and no adverse affect on signal reception, it is also hard with excellent scratch resistance, and is outstanding as an external member of a timepiece. Furthermore, if the bezel 112 is ceramic, the bezel 112 may be superimposed with the antenna electrode 42 in plan view. As a result, because the diameter of the outside case member 111 need not be increased so that the bezel 112 does not overlap the antenna electrode 42 in plan view, the diameter of the outside case member 111 can be reduced and a electronic timepiece 1 with a small plane area can be provided.

The electronic timepiece 1 in the foregoing embodiments has a date wheel 5, solar panel 25, and dial ring 32, but the invention is not so limited. More specifically, the electronic timepiece may be configured without a date wheel 5, solar panel 25, or dial ring 32.

The outside case member 111 and back cover 12 are connected to the ground part of the reception module 50 in the embodiments described above, but the invention is not so limited. More specifically, the outside case member 111 and back cover 12 do not need to be connected to the ground of the reception module 50.

The solar panel 25 in the foregoing embodiments has a notch 251 in the area superimposed with the planar antenna 40 in plan view, but the solar panel 25 is not limited to having a notch 251. The solar panel 25 simply needs to be configured so that it does not affect signal reception by the planar antenna 40, and may simply be shaped so that the solar panel does not overlap the planar antenna 40 in plan view. For example, part of the solar panel 25 may be removed to form an opening only where the solar panel 25 would overlap the planar antenna 40 in plan view, or the solar panel 25 may be formed in a semicircle and placed so that the solar panel does not overlap the planar antenna 40 in plan view.

The first magnetic shield 91, 91C and second magnetic shield 92, 92C are cut away to form the notches 915, 915C, 925, but the first magnetic shield and second magnetic shield are not limited to forms having a notch. More specifically, the first magnetic shield and second magnetic shield may be desirably shaped to achieve an appropriate distance to the planar antenna 40 considering the effect on reception.

The foregoing embodiments are described with reference to a GPS satellite S as an example of a positioning information satellite, but the invention is not limited to GPS satellites and can be used with Global Navigation Satellite Systems (GNSS) such as Galileo (EU), GLONASS (Russia), and Beidou (China). The invention can also be used with geostationary satellites in satellite-based augmentation systems (SBAS), and quasi-zenith satellites in radio navigation satellite systems (RNSS) that can only search in specific regions.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosures of Japanese Patent Application Nos. 2015-156169, filed Aug. 6, 2015 and 2016-023812, filed Feb. 10, 2016 are expressly incorporated by reference herein.

What is claimed is:

1. An electronic timepiece comprising:
a case of which at least part is metal;
a hand and a movement disposed inside the case;
the movement including a circuit board,
a planar antenna including an antenna electrode and being attached to the circuit board,
a motor configured to drive the hand, and
a magnetic shield superimposed in plan view with at least a part of a body of the motor, and not superimposed in plan view with the planar antenna, the magnetic shield including a first magnetic plate and a second magnetic plate, the first magnetic plate being disposed on a face side of the motor and the second magnetic plate being disposed on a back cover side of the motor; and
the shortest distance between the antenna electrode of the planar antenna and the metal part of the case being greater than the shortest distance between the antenna electrode and the first magnetic plate or the second magnetic plate.

2. The electronic timepiece described in claim 1, wherein:
the top of the metal part of the case at the end on the face side of the timepiece is above the antenna electrode on the face side of the timepiece.

3. The electronic timepiece described in claim 1, further comprising:
a solar panel not superimposed with the antenna electrode in plan view,
the shortest distance between the antenna electrode and the metal part of the case being greater than the shortest distance between the antenna electrode and an electrode of the solar panel.

4. The electronic timepiece described in claim 1, further comprising:
a battery not superimposed with the planar antenna in plan view,
the shortest distance between the antenna electrode and the metal part of the case being greater than the shortest distance between the antenna electrode and the battery.

5. The electronic timepiece described in claim 1, wherein:
the shortest distance between the antenna electrode and the first magnetic plate is greater than the shortest distance between the antenna electrode and the second magnetic plate.

6. An electronic timepiece comprising:
a case of which at least part is metal; and
a hand and a movement disposed inside the case, wherein the movement includes:
a circuit board,
a planar antenna including an antenna electrode and being attached to the circuit board,
a motor configured to drive the hand, and
a magnetic shield superimposed in plan view with at least a part of a body of the motor, and not superimposed in plan view with the planar antenna,
the shortest distance between the antenna electrode of the planar antenna and the metal part of the case is greater than the shortest distance between the antenna electrode and the magnetic shield, and the shortest distance between the antenna electrode and the magnetic shield is greater than the shortest distance between the antenna electrode and the electrode of the solar panel.

* * * * *